US005338638A

United States Patent [19]

Tsuchiya et al.

[11] Patent Number: 5,338,638

[45] Date of Patent: Aug. 16, 1994

[54] TONER FOR DEVELOPING ELECTROSTATIC IMAGE AND PROCESS FOR PRODUCTION THEREOF

[75] Inventors: Kiyoko Tsuchiya, Yokosuka; Koichi Tomiyama, Kawasaki; Masayoshi Kato, Iruma; Tsutomu Kukimoto; Hiroshi Yusa, both of Yokohama, all of Japan

[73] Assignee: Canon Kabushiki Kaisha, Tokyo, Japan

[21] Appl. No.: 797,992

[22] Filed: Nov. 26, 1991

[30] Foreign Application Priority Data

Nov. 29, 1990 [JP] Japan ..... 2-332693

[51] Int. Cl.[5] ..... G03G 9/087

[52] U.S. Cl. ..... 430/106; 430/109; 430/137

[58] Field of Search ..... 430/109, 110, 111, 137

[56] References Cited

U.S. PATENT DOCUMENTS

| | | | |
|---|---|---|---|
| 2,297,691 | 10/1942 | Carlson | 430/107 |
| 3,666,363 | 5/1972 | Tanaka et al. | 355/17 |
| 4,071,361 | 1/1978 | Marushima | 96/1.4 |
| 4,702,986 | 10/1987 | Imai et al. | 430/120 |
| 4,939,060 | 7/1990 | Tomiyama et al. | 430/106.6 |
| 5,077,168 | 12/1991 | Ogami et al. | 430/109 |
| 5,084,368 | 1/1992 | Hirayama et al. | 430/109 |
| 5,156,937 | 10/1992 | Alexandrovich et al. | 430/109 |
| 5,180,649 | 1/1993 | Kukimoto et al. | 430/109 |

FOREIGN PATENT DOCUMENTS

| | | |
|---|---|---|
| 331393 | 9/1989 | European Pat. Off. . |
| 393592 | 10/1990 | European Pat. Off. . |
| 51-23354 | 7/1976 | Japan . |
| 56-16144 | 2/1981 | Japan . |
| 57-178249 | 11/1982 | Japan . |
| 58-178250 | 11/1982 | Japan . |
| 58-86558 | 5/1983 | Japan . |
| 59-214860 | 12/1984 | Japan . |
| 60-166958 | 8/1985 | Japan . |
| 61-110155 | 5/1986 | Japan . |
| 61-110156 | 5/1986 | Japan . |
| 62-280757 | 12/1987 | Japan . |
| 63-214760 | 9/1988 | Japan . |
| 63-216063 | 9/1988 | Japan . |
| 63-217362 | 9/1988 | Japan . |
| 63-217363 | 9/1988 | Japan . |
| 63-217364 | 9/1988 | Japan . |
| 63-223662 | 9/1988 | Japan . |
| 1-172843 | 7/1989 | Japan . |
| 1-172844 | 7/1989 | Japan . |

OTHER PUBLICATIONS

Patent Abstracts of Japan, vol. 14, No. 415 (P-1102)[4358], Sep. 7, 1990 for JPA-02161464.

*Primary Examiner*—John Goodrow

*Attorney, Agent, or Firm*—Fitzpatrick, Cella, Harper & Scinto

[57] ABSTRACT

A toner for developing an electrostatic image is provided as a pulverized mixture including a binder resin and a colorant. The binder resin is characterized by a molecular weight distribution on a GPC chromatogram of its tetrahydrofuran (THF)-soluble resin content including at least 15% and below 35% of a resin component in a molecular weight region of at most 5000 and at least 3 wt. % of a resin component in a molecular weight region of at least $5\times10^6$ and showing a main peak in a molecular weight region of 5000 to $10^5$. The binder resin also has an acid value of 2–100 mg KOH/g. The THF-soluble resin component in the molecular weight region of at least $5\times10^6$ is enriched during a melt-kneading step during the toner production.

49 Claims, 2 Drawing Sheets

TONER FOR DEVELOPING ELECTROSTATIC IMAGE AND PROCESS FOR PRODUCTION THEREOF

FIELD OF THE INVENTION AND RELATED ART

The present invention relates to a toner for developing electrostatic images used in image forming methods such as electrophotography and a process for production thereof, particularly a toner which has been improved with respect to hot roller-fixability and developing performances for electrophotographic images and a process for production thereof.

Hitherto, a large number of electrophotographic processes have been known, inclusive of those disclosed in U.S. Pat. Nos. 2,297,691; 3,666,363; and 4,071,361. In these processes, in general, an electrostatic latent image is formed on a photosensitive member comprising a photoconductive material by various means, then the latent image is developed with a toner, and the resultant toner image is, after being transferred onto a transfer material such as paper etc., as desired, fixed by heating, pressing, or heating and pressing, or with solvent vapor to obtain a copy. The residual toner on the photosensitive member which is not transferred is cleaned by various methods, and then the above steps are repeated.

In recent years, such an electrophotographic image forming apparatus has been used not only as a copying machine for office work but also as a digital printer as an outputting means for a computer and a facsimile machine and also a graphic copier or printer for producing graphic copies of high definition.

Among the performances required of a toner for a digital printer or a copier for high definition images, fixability and developing reproducibility of thin line images is recognized as an important one.

As for the fixing step, various methods and apparatus have been developed, the most popular of which is a heating and pressing fixation system using hot rollers.

In the heating and pressing system, a sheet carrying a toner image to be fixed (hereinafter called "fixation sheet") is passed through hot rollers, while a surface of a hot roller having a releasability with the toner is caused to contact the toner image surface of the fixation sheet under pressure, to fix the toner image. In this method, as the hot roller surface and the toner image on the fixation sheet contact each other under pressure, a very good heat efficiency is attained for melt-fixing the toner image onto the fixation sheet to afford quick fixation, so that the method is very effective in a high-speed electrophotographic copying machine. In this method, however, a toner image in a melted state is caused to contact a hot roller surface under pressure, so that there is observed a so-called offset phenomenon wherein a part of the toner image is attached and transferred to the hot roller surface and then transferred back to the fixation sheet to stain the fixation sheet. It has been regarded as one of the important conditions in the hot roller fixation system to prevent the toner from sticking to the hot roller surface.

On the other hand, in a latent image for a high definition image portion, electric lines of force are concentrated at a boundary between an exposed part and a non-exposed part to provide an apparent local increase in surface potential. Particularly in a digital printer, a latent image is composed of ON-OFF binary picture elements to cause an intensive concentration of electric lines of force at the boundary between an exposed part and a non-exposed part, so that the amount of toner attached to a unit area of a latent line image composed of picture elements in the development step is larger than that for constituting an ordinary analog image. Accordingly, in the fixation of such an image, a toner having further enhanced fixing and anti-offset characteristics is required at present.

A printer is generally used to provide 3–5 times as many copies as prepared by a copying machine of the same level and requires a toner having further enhanced fixing and anti-offset performances.

As for the improvement of the binder resin for a toner, a toner using a crosslinked polymer as the binder resin has been proposed, e.g., in Japanese Patent Publication JP-B 51-23854. Such a toner using a crosslinked polymer shows improved in anti-offset characteristic and anti-winding characteristic but is caused to have an increased fixing temperature as the degree of crosslinking is increased. Accordingly, it is difficult to provide a toner showing a low fixing temperature, good anti-offset and anti-winding characteristic and also good fixability. In order to improve the fixability, it is generally required to use a lower molecular-weight binder resin having a lower softening point. This is contradictory to an improvement in anti-offset characteristic. Further, a lowering in glass transition point for providing a low softening point leads to an undesirable phenomenon of toner blocking during storage.

Further, as a toner comprising a low-molecular weight polymer and a crosslinked polymer, JP-A 58-86558 for example has proposed a toner comprising a low-molecular weight polymer and a non-fusible polymer as principal resin components. According to the teaching, the fixability actually tends to be improved, but it is difficult to satisfy the fixability and the anti-offset characteristic at high performances because the weight-average molecular weight/number-average molecular weight ratio (Mw/Mn) is as low as 3.5 or below and the non-fusible polymer content is as much as 40–90 wt. %. Actually, it has been very difficult to provide a toner with sufficient fixability and anti-offset characteristics unless it is used in a fixing device equipped with a means for supplying an offset-preventing liquid.

JP-A 60-166958 has proposed a toner comprising a resin component prepared by polymerization in the presence of a low-molecular weight poly-α-methylstyrene having a number-average molecular weight (Mn) of 500–1,500. The same patent specification describes that an Mn range of 9,000–30,000 is preferred but a higher Mn for improving the anti-offset characteristic leads to a practical problem in fixability.

JP-A 56-16144 has proposed a toner comprising a binder resin having at least a maximum in each of the molecular weight ranges of $10^3$–$8\times10^4$ and $10^5$–$2\times10^6$ in the molecular weight distribution according to GPC (gel permeation chromatography). The toner exhibits excellent performances with respect to pulverizability, anti-offset characteristic, fixability, anti-filming or anti-melting characteristic on a photosensitive member and image forming characteristic but further improvement in the anti-offset characteristic and fixability is desired. Particularly, it is desired to further improve the fixability while maintaining or even improving the other performances so as to meet the strict demands of these days.

On the other hand, as for physical properties required of a toner, several proposals have been made with respect to binder resins including: crosslinking by reaction of a polymer comprising a carboxylic acid with a metal compound (JP-A 57-178249, JP-A 57-178250, etc.) and reaction of a binder comprising a vinyl monomer and a specific half-ester compound as essential composition units with a polyvalent metal compound to cause crosslinking with the metal (JP-A 61-110155, JP-A 61-110156).

Further, JP-A 63-214760, JP-A 63-217362, JP-A 63-217363 and JP-A 63-217364 disclose reaction of a polymer having a molecular weight distribution including two portions; one a low-molecular weight portion and the other a high-molecular weight portion with the low-molecular weight portion including a carboxyl group and a polyvalent metal ion to cause crosslinking (more specifically adding a liquid dispersion of a metal compound into a solution after solution polymerization, followed by heating for the reaction). In any method, however, the reaction between the binder resin and the metal compound or the dispersion of the metal compound in the binder resin is not sufficient, so that the physical properties required of a toner, particularly the fixing characteristic and the anti-offset characteristic, are not satisfied. Further, as large amounts of the metal compound in a large amount is formulated with the binder resin, the metal compound can exhibit a catalytic action to the binder resin depending on the condition to cause gellation of the binder resin. Accordingly, it is difficult to determine the production condition for formulating the metal compound to obtain a desired toner. Even if the production conditions are determined, it is difficult to produce a toner with a good reproducibility.

Even if a binder resin contains a carboxyl group capable of reacting with a metal compound, its crosslinking reactivity is weak if the carboxyl group is in the form of an anhydride structure (i.e., a closed ring structure). As a result, the crosslinking intensity becomes insufficient, thus failing to provide satisfactory anti-offset characteristic and fixability.

Further, JP-A 63-216063 proposes the combination of ionic crosslinking with a metal in the binder resin and an offset-preventing agent, and JP-A 62-280757 proposes reaction of an acid anhydride group and a cationic component to form a polar functional group in the binder resin to improve the charging characteristic of a toner. It is however still difficult by these methods to provide a toner with all required properties, such as anti-offset characteristic, fixability and developing characteristic.

JP-A 59-214860 proposes a toner comprising a resin having a specific range of viscoelasticity for improvement in fixing characteristic and anti-offset characteristic. Although this toner shows some effect in respect of anti-offset characteristic, the combination of a low-temperature fixability and the anti-offset characteristic has not been fully satisfactory because of unduly high elasticity and viscosity an excessive frequency-dependence thereof.

JP-A 63-223662 discloses a binder resin having a THF-insoluble content of 10–60 parts and a THF-soluble content showing two peaks in its molecular weight distribution for improved anti-offset characteristic. However, further improved low-temperature fixability, anti-blocking characteristic and anti-offset characteristic are desired so as to be applicable to both high-speed and low-speed image forming apparatus.

As described above, it is very difficult to realize high performances with respect to both fixing performances (low-temperature fixability and anti-offset characteristic) and pulverizability. In particular, pulverizability in toner production is an important factor in view of the direction of recent demands for a smaller toner size so to realize high quality, high resolution and excellent thin-line reproducibility. The improvement in pulverizability is also important with regard to economization of energy consumption as the pulverization step requires a very high energy.

As another aspect, a cleaning step is involved in a copying cycle so as to remove a toner on a photosensitive member after a transfer step in another copying cycle. Nowadays, it is conventional to adopt a blade cleaning system so as to provide a compact and light apparatus and in view of its reliability. Along with achievement of a photosensitive member with an extended life, a photosensitive drum with a smaller diameter and a high speed system, the anti-sticking and anti-filming properties against a photosensitive member are strictly demanded of the toner. Particularly, an amorphous silicon photosensitive member recently developed has a high durability and an OPC (organic photoconductor) photosensitive member is also provided with an extended life, so that higher performances are required of the toner accordingly.

In order to provide a compact apparatus, it is necessary to adequately dispose various parts in narrow space. Accordingly, little spaces is left for passing cooling air and a heat-generating source such as a fixer is disposed closer to a toner hopper and a cleaner, so that the toner tends to be exposed to a high temperature atmosphere. For this reason, a toner cannot be practically used unless it has an excellent anti-blocking characteristic.

Along with the decreases in size and weight of the apparatus, the fixing roller is required to have a smaller diameter and exert a lower pressure. Further, there has been desired a toner which does not cause roller staining but has a sufficient anti-offset characteristic even in case of using a fixing roller cleaning member.

JP-A 1-172843 and JP-A 1-172844 have proposed toners which have peaks in molecular weight ranges of $3\times10^3$–$5\times10^3$ and $1.5\times10^5$–$2.0\times10^6$ and have a peak area percentage of 40–60% in a molecular weight region of $15\times10^5$–$2\times10^6$ or a gel content of 1–10% However, a further improvement has been desired.

Although several proposals have been made regarding use of toners having a small particle size for the purpose of providing high-quality images, this tends to be disadvantageous with respect to productivity, fixing performance and anti-offset characteristic. A binder resin and a toner solving the problem have been also desired.

As has been described above, various performances required of a toner are mutually contradictory in many cases, and it has been also required to satisfy them in combination at high levels in recent years.

SUMMARY OF THE INVENTION

An object of the present invention is to provide a toner having solved the above-mentioned problems and a process for production thereof.

An object of the present invention is to provide a toner which can be fixed at a low temperature and does not cause melt-sticking or filming onto a toner-carrying member or a photosensitive member in a long period of use, and a process for production thereof.

An object of the present invention is to provide a toner which can be fixed at a low temperature and is excellent in anti-blocking characteristic, thus being able to be used in a high temperature atmosphere of a small-size apparatus, and a process for production thereof.

An object of the present invention is to provide a toner which results in little coarse powder at the time of producing toner particles because of good pulverizability and causes little scattering around a toner image during development, thus being capable of stably providing good developed images, and a process for production thereof.

An object of the present invention is to provide a small particle size toner capable of forming high-quality images, and a process for production thereof.

A further object of the present invention is to provide a toner which is excellent in anti-blocking characteristic and free from agglomeration in circulation and storage, thus being excellent in storability, and a process for production thereof.

According to the present invention, there is provided a toner for developing an electrostatic image, comprising: a binder resin and a colorant, wherein the binder resin shows a molecular weight distribution on a GPC chromatogram of its tetrahydrofuran (THF)-soluble resin content including at least 15% and below 35% of a resin component in a molecular weight region of at most 5000 and at least 3 wt. % of a resin component in a molecular weight region of at least $5\times10^6$ and showing a main peak in a molecular weight region of 5000 to $10^5$ and the binder resin has an acid value of 2–100 mg KOH/g.

According to another aspect of the present invention, there is provided a process for producing a toner, comprising:

mixing a resin composition, a colorant and an organic metal compound to obtain a mixture, the resin composition containing a crosslinkage formed with a crosslinking agent having at least two vinyl groups and a carboxyl group;

heating said mixture;

melt-kneading the heated mixture while exerting a shearing force to the mixture, so as to sever molecular chains of a high molecular weight component in the resin composition under the action of the shearing force and form an electrostatic linkage between the carboxylic group and the organic metal compound or a metal ion in the organic metal compound under heating;

cooling the resultant kneaded product;

pulverizing the cooled kneaded product; and classifying the resultant pulverized product to obtain a toner;

the toner comprising a binder resin and a colorant; wherein the binder resin shows a molecular weight distribution on a GPC chromatogram of its tetrahydrofuran (THF)-soluble resin content including at least 15% and below 35% of a resin component in a molecular weight region of at most 5000 and at least 3 wt. % of a resin component in a molecular weight region of at least $5\times10^6$ and showing a main peak in a molecular weight region of 5000 to $10^5$, and the binder resin has an acid value of 2–100 mg KOH/g.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
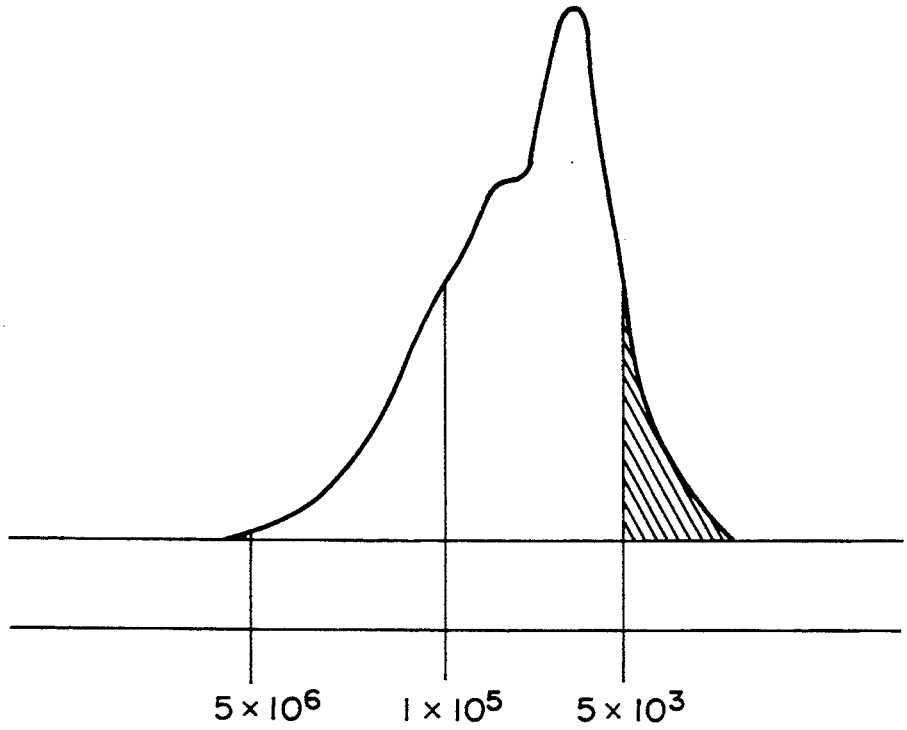
FIG. 1 is a GPC (gel permeation chromatography) chromatogram of a resin composition A.

First of all, the binder resin used in the toner of the present invention will be described.

The molecular weight distribution of the THF (tetrahydrofuran)-soluble content of a binder resin or other resins used in the present invention may be measured based on a chromatogram obtained by GPC (gel permeation chromatography) in the following manner.

A GPC sample is prepared as follows.

A resinous sample is placed in THF and left standing for several hours (e.g., 5–6 hours). Then, the mixture is sufficiently shaken until a lump of the resinous sample disappears and then further left standing for more than 12 hours (e.g., 24 hours) at room temperature. In this instance, a total time of from the mixing of the sample with THF to the completion of the standing in THF is at least 24 hours (e.g., 24–30 hours). Thereafter, the mixture is caused to pass through a sample treating filter having a pore size of 0.45–0.5 micron (e.g., "Maishoridisk H-25-5", available from Toso K.K.; and "Ekikurodisk 25CR", available from German Science Japan K.K.) to recover the filtrate as a GPC sample. The sample concentration is adjusted to provide a resin concentration within the range of 0.5–5 mg/ml.

The binder resin contained in the toner of the present invention may preferably have a THF-insoluble resin content, as recovered by the above filter treatment, of at most 10 wt. %, further preferably at most 5 wt. % and, most preferably substantially zero, as measured at a concentration of 5 mg/ml at room temperature, so as to exhibit the effect of the present invention.

In the GPC apparatus, a column is stabilized in a heat chamber at 40 ° C., tetrahydrofuran (THF) solvent is caused to flow through the column at that temperature at a rate of 1 ml/min., and about 100 μl of a GPC sample solution is injected. The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be those having molecular weights in the range of about $10^2$ to $10^7$ available from, e.g., Toso K.K. or Showa Denko K.K. It is appropriate to use at least 10 standard polystyrene samples. The detector may be an RI (refractive index) detector. For accurate measurement, it is appropriate to constitute the column as a combination of several commercially available polystyrene gel columns. A preferred example thereof may be a combination of Shodex KF-801, 802, 803, 804, 805, 806, 807 and 800P; or a combination of TSK gel G1000H ($H_{XL}$), G2000H ($H_{XL}$), G3000H ($H_{XL}$), G4000H ($H_{XL}$), G5000H ($H_{XL}$), G6000H ($H_{XL}$), G7000H ($H_{XL}$) and TSK guardcolumn available from Toso K.K.

The contents of a component having a molecular weight of 5000 or below and a component having a molecular weight of $5\times10^6$ or above on a GPC chromatogram measured by calculating ratios of the integrated values of a molecular weight region of 5000 or below and a molecular weight region of $5\times10^6$ or above, respectively, to the integrated value of the entire molecular weight region of a sample resin. Alternatively, it is possible to measure the content of a component having a molecular weight of 5000 or below (or $5\times10^6$ or above) by cutting out a GPC chromatogram of the corresponding molecular weight region and a calculating a ratio of the weight thereof to that of a GPC chromatogram covering the entire molecular weight region.

Figure 2:
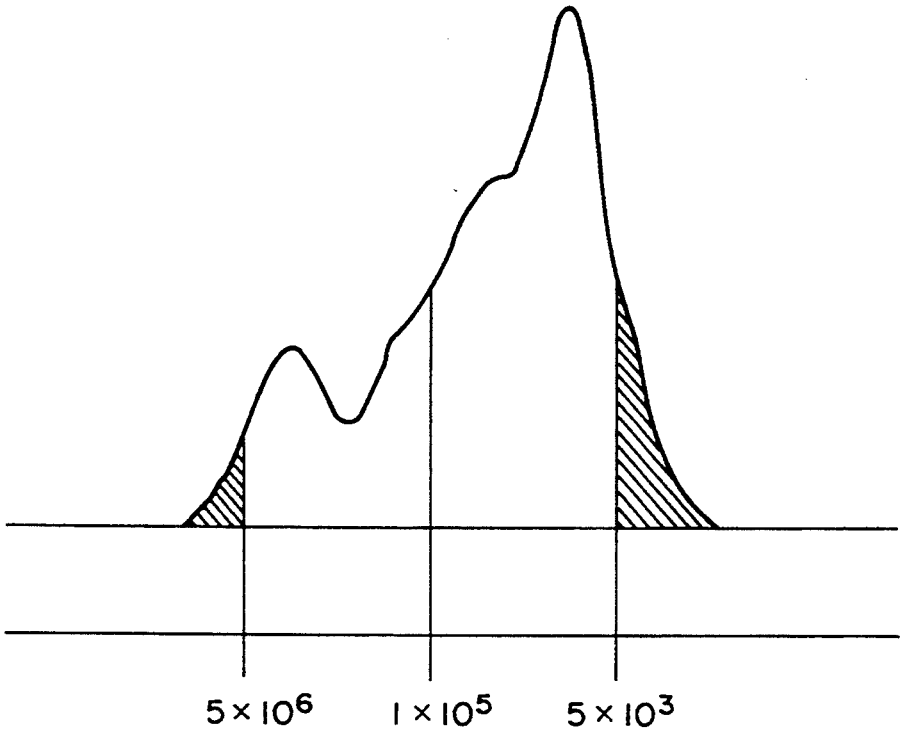
FIG. 2 is a GPC chromatogram of a resin composition obtained by kneading the resin composition A.
Figure 3:
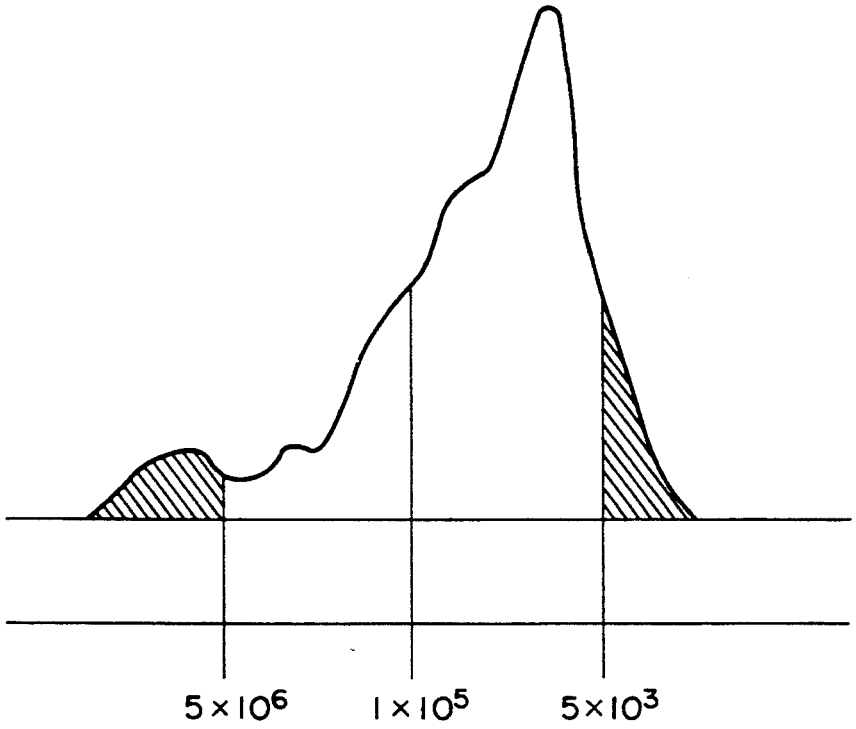
FIG. 3 is a GPC chromatogram of a resin composition obtained by kneading the resin composition A and an organic metal compound.

More specifically, for example, by measuring the areal or weight proportion of hatched portions in GPC chromatogram shown in FIGS. 1-3, the content of resin components having molecular weights of at most 5000 and at least $5\times10^6$ may be respectively obtained.

The binder resin of the present invention is characterized by containing at least 15% and below 35%, preferably 18–32%, of a resin component having a molecular weight of at most 5000 in terms of molecular weight distribution based on the GPC chromatogram so as to provide an improved anti-blocking characteristic.

By containing 15% to below 35% of a resin component having a molecular weight of at most 5000, the toner binder resin prevents excessive pulverization to suppress occurrence of ultra-fine powder and coarse powder and increase the production efficiency at the time of toner production, and further provides a toner showing good developing characteristic.

If the resin component having a molecular weight of at most 5000 is 35% or more, there are observed tendencies for melt-sticking or filming of the toner onto a toner-carrying member (development sleeve) having a diameter of at most 20 mm and a photosensitive drum having a diameter of at most 50 mm is pronounced in a small-size apparatus, and the storability of the toner becomes worse.

The resin component having a molecular weight of at most 5000 is liable to have a glass transition point (Tg) showing a noticeable molecular weight-dependence. Accordingly, if the resin component is contained in excess of 35%, the binder resin is caused to show a thermal behavior as if it has a lower Tg than its ordinarily measured Tg and is liable to cause melt-sticking and filming.

The resin component having a molecular weight of at most 5000 has a function of providing a melt-kneaded product with a particularly improved pulverizability at the time of toner production but provides an excessive pulverizability in production of a toner having a volume-average particle size of 4–8 microns to result in much ultra-fine powder and a lower classification efficiency if it is contained in excess of 35%. A toner containing insufficiently classified ultra-fine powder is caused to have a gradually increased content of such ultra-fine powder through repetition of toner replenishment, and the increased ultra-fine powder is attached to a triboelectric toner-charging member due to an electrostatic force to hinder the triboelectric charging of the toner, thus causing a lowering in image density and fog. For a toner of a small particle size having an increased specific surface area, it is necessary to improve the toner binder resin in order to maintain the fixability and anti-offset characteristic.

The toner binder resin used in the present invention is characterized by containing a resin component having a molecular weight of at least $5\times10^6$ in a proportion of at least 3%, preferably 3–20%, particularly preferably 3–10%. The resin component having a molecular weight of at least $5\text{–}10^6$ shows excellent releasability and appropriately suppresses the fluidity of the toner at a high temperature, so that the component effectively functions to improve the anti-offset characteristic.

If the resin component having a molecular weight of at least $5\times10^6$ is below 3%, the anti-offset characteristic is liable to be insufficient. In excess of 20%, the toner cannot be readily deformed on melting to inhibit the fixing, and also the component in a suitable molecular weight region for fixing is relatively decreased to again inhibit the improvement in fixability.

As a conventional technique, it has been known to incorporate in a binder resin a gel component (i.e., a component which cannot pass a screen of 80 mesh or 200 mesh when the binder resin is dissolved or dispersed in toluene because of a dense crosslinked network structure or large molecular weight) so as to provide the toner with a rubber elasticity. The resin component having a molecular weight of at least $5\times10^6$ used in the present invention has a larger crosslinked network structure and less crosslinkage than such a gel component, so that the polymer molecules are in a rather mobile state and do not excessively resist the deformation of the toner or hinder the fixation.

It is preferred that a resin component having a molecular weight in the range of $10^5$ to $5\times10^6$ is at most 35%, particularly 10–30%.

The component in this molecular weight region functions as a component effective for-improving the anti-offset characteristic resisting a high-temperature offset (toner sticking onto fixing rollers at a high temperature). The resin component having a molecular weight in the range of $10^5$ to $5\times10^6$ principally functions as a component linking a medium molecular weight component and the ultra-high molecular weight component having a molecular weight of at least $5\times10^6$ and functions to uniformize the anti-offset component and the fixing component in the binder resin and aid the dispersion of internal additives to the toner, such as a colorant and a charge control agent in the toner.

The binder resin of the present invention is characterized by showing a main peak (the highest peak) in a molecular weight region of 5000 to $10^5$, particularly in a region of $10^4$ to $5\times10^4$.

In case where there are several peaks, it is also preferred that a sub-peak having a height which is a half or more of that of the main peak is in the molecular weight range of $5000\text{–}10^5$.

A component having a molecular weight of at most $10^4$ functions as a component for improving the pulverizability of a toner material at the time of toner production, and the component in the molecular weight region of $5000\text{–}10^5$ is a component for improving the fixability of the toner.

In order to incorporate these components in the binder resin in a large proportion and in a good balance, the binder resin is required to show a main peak in the above-mentioned molecular weight region. As a result, it is possible to attain a good pulverizability of the toner material in toner production and also a good fixability of the toner. So as to be a measure component, the component in the molecular weight region of 5000 to $10^5$ may preferably be contained in a proportion of at least 40%, further preferably at least 45%. It is also a preferred mode that a single peak in this region is present in the region of $10^4$ to $5\times10^4$.

If the main peak is at a molecular weight of below 5000, the same difficulties as in the above-mentioned case of the component having a molecular weight of at most 5000 being 35% or more are encountered. If the main peak is present at a molecular weight in excess of $10^5$, it becomes impossible to attain a sufficient fixability and pulverizability. As the molecular weight giving the main peak exceeds about $5\times10^4$ the pulverizability of the toner material begins to be gradually lowered.

As a method of obtaining a vinyl polymer satisfying the characteristic features of the present invention, it is possible to obtain a vinyl copolymer by using a vinyl monomer having an acid group, such as a dicarboxylic acid, a dicarboxylic anhydride or a dicarboxylic acid monoester with another vinyl monomer and subjecting the monomers to bulk polymerization or solution polymerization. In the solution polymerization, it is possible to convert a part of the dicarboxylic acid groups or dicarboxylic acid monoester groups in the vinyl copolymer into anhydride groups by adjusting the conditions for distilling off the solvent after the polymerization. It is also possible to further convert such dicarboxylic acid group and dicarboxylic acid monoester group into anhydride groups by heat-treating the vinyl copolymer obtained by the bulk polymerization or solution polymerization. A part of such anhydride groups can be reacted with a compound such as an alcohol to be esterified.

Reversely, it is also possible to convert a part of such anhydride groups by ring-opening through hydrolysis of the vinyl copolymer obtained above into dicarboxylic acid groups.

On the other hand, dicarboxylic acid monoester groups of a vinyl copolymer can be obtained by suspension polymerization or emulsion polymerization using a vinyl monomer including such a dicarboxylic acid monoester group into anhydride groups by heat-treatment or into dicarboxylic acid groups by hydrolysis. If such a vinyl copolymer obtained by bulk polymerization or solution polymerization is dissolved in a vinyl monomer and the resultant mixture is subjected to suspension polymerization or emulsion polymerization, a part of the anhydride groups can cause ring-opening to leave dicarboxylic acid groups in the polymer. In this instance, it is possible to mix another resin in the vinyl monomer. The resultant resin can be treated by heating, weak alkaline water or an alcohol for anhydrization, ring-opening or esterification.

A vinyl monomer having a dicarboxylic acid group and a vinyl monomer having a dicarboxylic anhydride group have a strong tendency to form an alternating copolymer. For this reason, in order to obtain a vinyl copolymer containing functional groups, such as anhydride groups or dicarboxylic acid groups, at random therein, the following method may be adopted as a suitable measure. That is, a vinyl copolymer is obtained through solution polymerization by using a vinyl monomer having a dicarboxylic acid monoester group and another vinyl monomer, and a solution of the vinyl copolymer in a vinyl monomer is subjected to suspension polymerization to obtain a binder resin. In this method, it is possible to anhydrize the dicarboxylic monoester part through de-alcohol cyclization by controlling the conditions for distilling-off of the solvent after the solution polymerization to obtain a vinyl copolymer having anhydride groups.

Then, at the time of the suspension polymerization, the anhydride groups cause ring-opening through hydrolysis to provide a vinyl copolymer having dicarboxylic acid groups.

The formation or extinction of an anhydride group in a polymer may be confirmed by an IR analysis because an anhydride group provides an IR absorption peak which has been shifted from those of the corresponding acid group and ester group toward a higher wave number side.

The binder resin used in the present invention has an acid value measured according to JIS K-0070 (hereinafter referred to as "JIS acid value" or simply as "acid value") of 2–100 mgKOH/g, preferably 5–70 mgKOH/g. If the acid value is below 2 mgKOH/g, re-crosslinking as described hereinafter cannot be sufficiently caused. If the acid value exceeds 100 mgKOH/g, it becomes difficult to effect the toner charge control, thus being liable to cause a fluctuation in developing characteristic depending on environmental conditions. It is preferred that an acid value attributable to the acid anhydride group is at most 10 mgKOH/g, further preferably below 6 mgKOH/g. If the acid value attributable to the acid anhydride group exceeds 10 mgKOH/g, vigorous re-crosslinking is caused to be liable to result in excessive crosslinkage and deterioration in fixability due to hindrance of movement of polymer molecule chains. Further, the control of the crosslinking degree in the binder resin becomes difficult. This is because the acid anhydride group is richer in reactivity than the other acid groups.

Because of its acid value, the binder resin provides a toner with an increased releasability with respect to the fixing rollers.

If the resin component having molecular weight of at least $5\times10^6$ has an acid value, the polar group providing the acid group in the polymer chain can form a weak bond due to affinity given by a hydrogen bond with polar groups in magnetic material, pigment and/or dye internally added to the for a toner accordingly, it becomes possible to compatibly satisfy the anti-offset characteristic and fixability of the toner. If the acid anhydride group is contained excessively, the crosslinking is promoted to provide an insoluble content which cannot pass through the filter for preparing a GPC sample solution and thus cannot be observed on a GPC chromatogram.

The acid value attributable to an acid anhydride group may for example be measure by combining the JIS acid value measurement and the acid value measurement through hydrolysis (total acid value measurement).

For example, the JIS acid value measurement provides an acid value of an acid anhydride which is about 50% of the theoretical value (based on an assumption that a mol of an acid anhydride provides an acid value identical to the corresponding dicarboxylic acid).

On the other hand, the total acid value measurement provides an acid value which is almost identical to the theoretical value. Accordingly, the difference between the total acid value and the JIS acid value is almost 50% for an acid anhydride. Thus, the acid value attributable to an acid anhydride group per g of a resin can be obtained by doubling the difference between the total acid value and the JIS acid value of the resin.

The method of the JIS acid value measurement is explained hereinbelow.

2–10 g of a sample resin is weighed and placed in a 200 to 300 ml-Erlenmeyer flask, and an ethanol/benzene (=½) mixture is added thereto to dissolve the resin. If the resin is not readily dissolved, a small amount of acetone may be added. The resultant solution is titrated with a preliminarily standardized N/10 KOH/alcohol solution with phenolphthalein as the indicator. The acid value is calculated from the consumption of the KOH-/alcohol solution based on the following equation:

$$\text{Acid value} = \text{vol (ml) of KOH/alcohol} \times N \times 56.1/\text{sample weight},$$

wherein N denotes the factor of the N/10 KOH/alcohol solution.

The total acid value of a binder resin used herein is measured in the following manner. A sample resin in an amount of 2 g is dissolved in 30 ml of dioxane, and 10 ml of pyridine, 20 mg of dimethylaminopyridine and 3.5 ml of water are added thereto, followed by 4 hours of heat refluxing. After cooling, the resultant solution is titrated with 1/10 N-KOH solution in THF (tetrahydrofuran) to neutrality with phenolphthalein as the indicator to measure the acid value, which is a total acid value (B).

The above-mentioned 1/10 N-KOH solution in THF is prepared as follows. First, 1.5 g of KOH is dissolved in about 3 ml of water, and 200 ml of THF and 30 ml of water are added thereto, followed by stirring. After standing, a uniform clear solution is formed, if necessary, by adding a small amount of methanol if the solution is separated or by adding a small amount of water if the solution is turbid. Then, the factor of the 1/10 N-KOH/THF solution thus obtained is standardized by a 1/10 N-HCl standard solution.

The binder resin used in the present invention may for example be prepared in following manner.

A polymer or copolymer (A-1) having a main peak in a molecular weight region of $2000–2\times10^4$ is prepared through solution polymerization, bulk polymerization, suspension polymerization, emulsion polymerization, block copolymerization or graft polymerization.

Then, the polymer or copolymer (A-1) is dissolved in a polymerizable monomer mixture containing 0.5–20 wt. %, preferably 1–15 wt. %, of a carboxyl group-containing vinyl monomer, followed by suspension polymerization to prepare a polymer or copolymer (B-1) which shows a main peak in a molecular weight region of $5000–10^5$ on a GPC chromatogram but can contain a gel content (THF-insoluble).

The polymer or copolymer is melt-kneaded together with a metal-containing compound reactive with the carboxyl group in the polymer or copolymer under the action of a shearing force so as to sever a highly crosslinked polymer portion in the resin and cause a reaction with the metal-containing compound for re-crosslinking to provide a molecular weight distribution characteristic to the present invention. This process may be performed simultaneously at the time of toner production and thus the melt-kneading can be performed in the presence of a magnetic material or colorant. It is possible to effectively cause the re-crosslinking under the action of a heat evolved due to the severance of the polymer network.

In the case of severance of the highly crosslinked polymer component during melt-kneading, the severance may be effected by kneading the mixture in a low-temperature melting state so as to apply a high shearing force to the mixture. Then, the re-crosslinking with a metal-containing component, etc., under the action of a heat results in a component having a molecular weight of at least $5\times10^6$.

If an extruder is used for example and an axial arrangement suitable for applying a shear force is adopted and operated at a relatively low set temperature, a high shearing force is applied to the mixture when the mixture passes through the kneading section to sever the polymer network and then cause the re-crosslinking by reaction of the resin with the metal-containing compound while the mixture is discharged and cooled.

A GPC chromatogram (chart) of a resin composition A used in Example 1 appearing hereinafter is reproduced herein as FIG. 1. The resin composition contains a THF-insoluble content which is removed by a filter when a GPC sample solution is prepared and thus cannot be observed by GPC. A GPC chromatogram of a resin composition obtained by kneading the resin composition A by a kneader used in Example 1 is reproduced as FIG. 2. The resin composition does not contain a THF-insoluble resin component and the severed high-molecular weight component appears as a peak on the chromatogram. Further, a GPC chromatogram of a composition obtained by kneading the resin composition A with a metal-containing compound is reproduced as FIG. 3, wherein a component formed by re-crosslinking is extended to a higher molecular weight side.

As an alternative method for preparing a binder resin according to the present invention, it is possible to prepare a polymer or copolymer (B-2) capable of containing a gel content having a main peak in the molecular weight region of $5000–10^5$ on a GPC chromatogram by suspension polymerization of a polymerizable monomer mixture containing 0.5–20 wt. %, preferably 1–15 wt. %, of a carboxylic group-containing vinyl monomer, and a polymer or copolymer (A-2) having a main peak in the molecular weight region of $2000–10^5$ by solution polymerization, bulk polymerization, suspension polymerization, block copolymerization or graft polymerization, and blending the polymer or copolymer (B-2) and the polymer or copolymer (A-2) by melt-kneading.

It is also possible to blend a polymer or copolymer (B-3) having a carboxyl group or a carboxyl derivative group and comprising a principal component in the molecular weight region of at least $10^5$ obtained by bulk polymerization, suspension polymerization, emulsion polymerization, etc., with the polymer or copolymer (A-1) or the polymer or copolymer (A-2) in a solvent after solution polymerization, and to melt-knead the blend.

It is also possible to melt-knead a blend of the polymer or copolymer (B-3) with the polymer or copolymer (A-1) or the polymer or copolymer (A-2).

If the respective polymers or copolymers in the above-mentioned resins have main peaks in the range of $5000–5\times10^4$, it is also a preferred mode that the polymers or copolymers are prepared so as to have peaks overlapping each other.

It is also preferred to have the polymer or copolymer (A-1) and/or the polymer or copolymer (A-2) contain a carboxyl group or a derivative group thereof.

The polymer or copolymer(s) used in the present invention may preferably be a vinyl resin and can be a mixture of two resins, or can assume a block copolymer or a graft copolymer form.

In the bulk polymerization, it is possible to obtain a low-molecular weight polymer by performing the polymerization at a high temperature so as to accelerate the termination reaction, but there is a difficulty that the reaction control is difficult. In the solution polymerization, it is possible to obtain a low-molecular weight polymer or copolymer under moderate conditions by utilizing a radical chain transfer function depending on a solvent used or by selecting the polymerization initiator or the reaction temperature. Accordingly, the solution polymerization is preferred for preparation of a low-molecular weight polymer or copolymer used in the binder resin of the present invention.

The solvent used in the solution polymerization may for example include xylene, toluene, cumene, cellosolve acetate, isopropyl alcohol, and benzene. It is preferred to use xylene, toluene or cumene for a styrene monomer mixture. The solvent may be appropriately selected depending on the polymer produced by the polymerization. The polymerization initiator may for example include: di-tert-butyl peroxide, tert-butyl peroxybenzoate, benzoyl peroxide and 2,2'-azobis(2,4-dimethylvaleronitrile). One or more species of the initiator may be used in a proportion of at least 0.05 wt. %, preferably 0.1–15 wt. parts, per 100 wt. parts of the vinyl monomer(s). The reaction temperature may depend on the solvent and initiator used and the polymer or copolymer to be produced but may suitably be in the range of 70–230 ° C. In the solution polymerization, it is preferred to use 30–400 wt. parts of a vinyl monomer (mixture) per 100 wt. parts of the solvent. It is also preferred to mix one or more other polymers in the solution after completion of the polymerization.

In order to produce a highly-crosslinked high-molecular weight polymer component, emulsion polymerization or suspension polymerization may preferably be adopted.

Of these, in the emulsion polymerization method, a vinyl monomer almost insoluble in water is dispersed as minute particles in an aqueous phase with the aid of an emulsifier and is polymerized by using a water-soluble polymerization initiator. According to this method, the control of the reaction temperature is easy, and the termination reaction velocity is small because the polymerization phase (an oil phase of the vinyl monomer possibly containing a polymer therein) constitutes a separate phase from the aqueous phase. As a result, the polymerization velocity becomes large and a polymer having a high polymerization degree can be prepared easily. Further, the polymerization process is relatively simple, the polymerization product is obtained in fine particles, and additives such as a colorant, a charge control agent and others can be blended easily for toner production. Therefore, this method can be advantageously used for production of a toner binder resin.

In the emulsion polymerization, however, the emulsifier added is liable to be incorporated as an impurity in the polymer produced, and it is necessary to effect a post-treatment such as salt-precipitation in order to recover the product polymer. The suspension polymerization is more convenient in this respect.

On the other hand, in the suspension polymerization method, it is possible to obtain a product resin composition in a uniform state of pearls containing a medium- or high-molecular weight component uniformly mixed with a low-molecular weight component and a crosslinked component by polymerizing a vinyl monomer (mixture) containing a low-molecular weight polymer together with a crosslinking agent in a suspension state.

The suspension polymerization may preferably be performed by using at most 100 wt. parts, preferably 10–90 wt. parts, of a vinyl monomer (mixture) per 100 wt. parts of water or an aqueous medium. The dispersing agent may include polyvinyl alcohol, partially saponified form of polyvinyl alcohol, and calcium phosphate, and may preferably be used in an amount of 0.05–1 wt. part per 100 wt. parts of the aqueous medium while the amount is affected by the amount of the monomer relative to the aqueous medium. The polymerization temperature may suitably be in the range of 50–95 ° C. and selected depending on the polymerization initiator used and the objective polymer. The polymerization initiator should be insoluble or hardly soluble in water, and A example include benzoyl peroxide and tert-butyl peroxyhexanoate. The initiator may be used in an amount of 0.5–10 wt. parts per 100 wt. parts of the vinyl monomer (mixture).

Examples of the vinyl monomer-to be used for providing the binder resin of the present invention may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylenically unsaturated monoolefins, such as ethylene, propylene, butylene, and isobutylene; unsaturated polyenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacryronitrile, and acrylamide; the esters of the above-mentioned $\alpha,\beta$-unsaturated acids and the diesters of the above-mentioned dibasic acids. These vinyl monomers may be used singly or in combination of two or more species.

Among these, a combination of monomers providing styrene-type copolymers and styrene-acrylic type copolymers may be particularly preferred.

It is further preferred that two or more species of acrylic monomers, such as acrylate esters and methacrylate esters, are used, and particularly these are preferentially contained in the resin component having a molecular weight of at least $5\times10^6$, so as to promote the toner deformation in a hot roller fixer.

Examples of the carboxyl group-containing vinyl monomer or carboxyl derivative group-containing vinyl monomer may include: unsaturated dibasic acids, such as maleic acid, citraconic acid, itaconic acid, alkenylsuccinic acid, fumaric acid, and mesaconic acid; unsaturated dibasic acid anhydrides, such as maleic anhydride, citraconic anhydride, itaconic anhydride, and alkenylsuccinic anhydride; half esters of unsaturated dibasic acids, such as monomethyl maleate, monoethyl maleate, monobutyl maleate, monomethyl citraconate, monoethyl citraconate, monobutyl citraconate, monomethyl itaconate, monomethyl alkenylsuccinate, monomethyl fumarate, and monomethyl mesaconate; and unsaturated dibasic acid esters, such as dimethyl maleate and dimethyl fumarate. Further, there may also be used: $\alpha,\beta$-unsaturated acids, such as acrylic acid, methacrylic acid, crotonic acid, and cinnamic acid; $\alpha,\beta$-unsaturated acid anhydrides, such as crotonic anhydride and cinnamic anhydride; anhydes between such $\alpha,\beta$-unsaturated acids and lower fatty acids; alkenylmalonic acid, alkenylglutaric acid, alkenyladipic acid, and anhydrides and monoesters of these acids.

Among the above, it is particularly preferred to use monoesters of $\alpha,\beta$-unsaturated dibasic acids, such as maleic acid, fumaric acid and succinic acid as a monomer for providing the binder resin used in the present invention.

The crosslinking monomer may principally be a monomer having two or more polymerizable double bonds.

The binder resin used in the present invention may preferably include a crosslinking structure obtained by using a crosslinking monomer, examples of which are enumerated hereinbelow.

Aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene(2)-2,2-bis(4-hydroxyphenyl)propanediacrylate, polyoxyethylene(4)-2,2-bis(4-hydroxyphenyl)propanediacrylate, and compounds obtained by substituting methacrylate groups for the acrylate groups in the above compounds; and polyester-type diacrylate compounds, such as one known by a trade name of MANDA (available from Nihon Kayaku K.K.). Polyfunctional crosslinking agents, such as pentaerythritol triacrylate, trimethylethane triacrylate, tetramethylolmethane tetracrylate, oligoester acrylate, and compounds obtained by substituting methacrylate groups for the acrylate groups in the above compounds; triallyl cyanurate and triallyl trimellitate.

These crosslinking agents may preferably be used in a proportion of about 0.01–5 wt. parts, particularly about 0.03–3 wt. parts, per 100 wt. parts of the other vinyl monomer components.

Among the above-mentioned crosslinking monomers, aromatic divinyl compounds (particularly, divinylbenzene) and diacrylate compounds connected with a chain including an aromatic group and an ether bond may suitably be used in a toner resin in view of fixing characteristic and anti-offset characteristic.

The metal-containing compound reactive with the resin component in the present invention may be those containing metal ions as follows: divalent metal ions, such as $Ba^{2+}$, $Mg^{2+}$, $Ca^{2+}$, $Hg^{2+}$, $Sn^{2+}$, $Pb^{2+}$, $Fe^{2+}$, $Co^{2+}$, $Ni^{2+}$ and $Zn^{2+}$; and trivalent ions, such as $Al^{3+}$, $Sc^{3+}$, $Fe^{3+}$, $Ce^{3+}$, $Ni^{3+}$, $Cr^{3+}$ and $Y^{3+}$.

Among the above metal compounds, organic metal compounds provide excellent results because they are rich in compatibility with or dispersibility in a polymer and cause a crosslinking reaction uniformly in the polymer or copolymer.

Among the organic metal compounds, those containing an organic compound, which is rich in vaporizability or sublimability, as a ligand or a counter ion, are advantageously used. Among the organic compounds forming coordinate bonds or ion pairs with metal ions, examples of those having the above property may include: salicylic acid and its derivatives, such as salicylic acid, salicylamide, salicylamine, salicylaldehyde, salicylosalicylic acid, and di-tert-butylsalicylic acid; $\beta$-diketones, such as acetylacetone and propionylacetone; and low-molecular weight carboxylic acid salts, such as acetate and propionate.

In case where the organic metal complex is a metal complex, it can also function as a charge control agent for toner particles. Examples of such a metal complex include azo metal complexes represented by the following formula [I]:

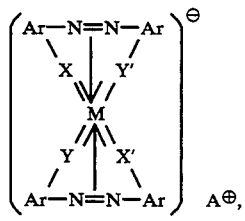

[I]

wherein M denotes a coordination center metal, inclusive of metal elements having a coordination number of 6, such as Sc, Ti, V, Cr, Co, Ni, Mn and Fe; Ar denotes an aryl group, such as phenyl or naphthyl, capable of having a substituent, examples of which may include: nitro, halogen, carboxyl, anilide, and alkyl and alkoxy having 1–18 carbon atoms; X, X'Y and Y' independently denote —O—, —CO—, —NH—, or —NR— (wherein R denotes an alkyl having 1–4 carbon atoms; and A⊕ denotes hydrogen, sodium, potassium, ammonium or aliphatic ammonium.

Specific examples of this type of complexes may include the following:

Complex [I] -1

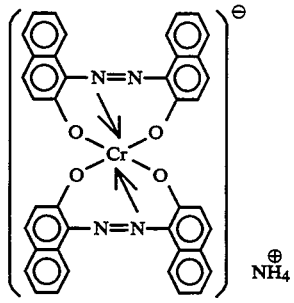

-continued

Complex [I] -2

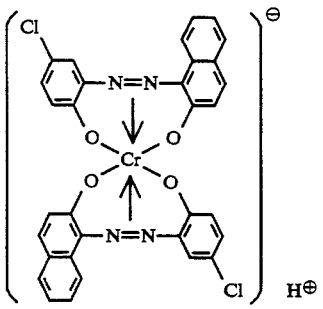

Complex [I] -3

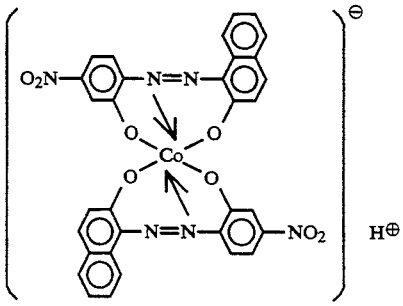

Complex [I] -4

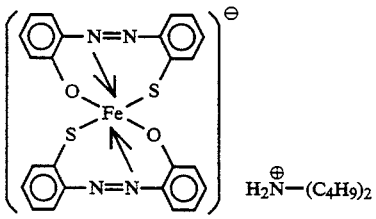

Complex [I] -5

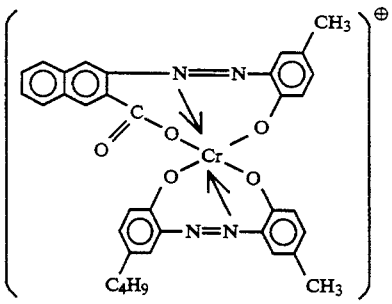

Complex [I] -6

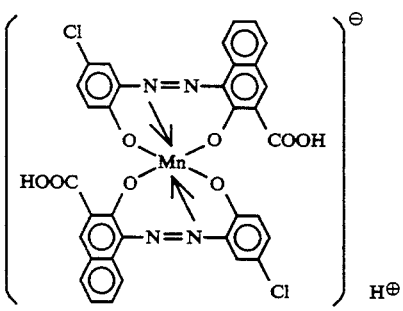

Organic metal complexes represented by the following formula [II] impart a negative chargeability and may be used as the organic metal compound in the present invention.

[II]

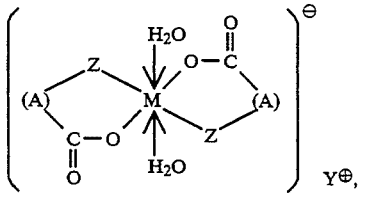

wherein M denotes a coordination center metal, inclusive of metal elements having a coordination number of 6, such as Cr, Co, Ni, Mn and Fe; A denotes

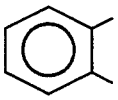

(capable of having a substituent, such as an alkyl ),

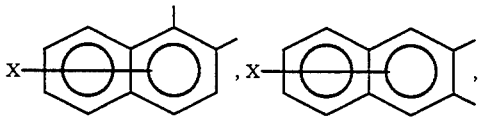

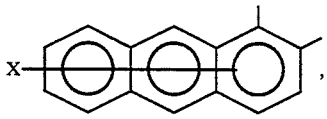

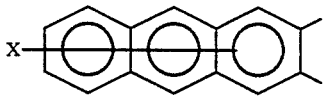

(X denotes hydrogen, halogen, alkyl or nitro),

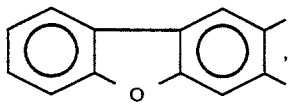

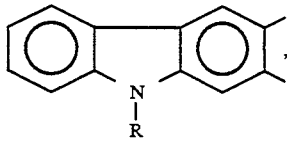

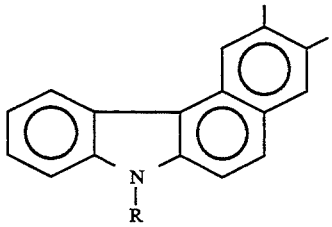

(R denotes hydrogen, $C_1$–$C_{18}$ alkyl or $C_1$–$C_{18}$ alkenyl); Y⊕ denotes a counter ion, such as hydrogen, sodium, potassium, ammonium, or aliphatic ammonium; and Z denotes —O— or —CO—or —CO·O—.

The above organic metal compounds may be used singly or in combination of two or more species.

The addition amount of the organic metal compounds to the toner particles may be varied depending on the specific binder resin used, the use or nonuse of a carrier, the colorant for the toner and the reactivity of the metal compounds with the resin but may generally be 0.1–10 wt. %, preferably 0.1–1 wt. %, of the binder resin including the non-reacted portion thereof.

As a low fixing roller pressure is used in a small size copying machine or printer, excessive re-crosslinking results in inferior fixability. Accordingly, the amount of the reactive metal compound may preferably be below 1 wt. % of the binder resin.

The above-mentioned organic metal complex or organic metal salt shows excellent compatibility and dispersibility to provide a toner with a stable chargeability, particularly when it is reacted with the binder resin at the time of melt-kneading.

As described above, the organic metal complex or organic metal salt as a crosslinking component can be also used as a charge control agent, but it is also possible to use another charge control agent, as desired, in combination. Such another charge control agent may for example be a known negative charge control agent.

Examples of such known negative charge control agents may include: organic metal complexes and chelate compounds inclusive of monoazo metal complexes as described above, acetylacetone metal complexes, and organometal complexes of aromatic hydroxycarboxylic acids and aromatic dicarboxylic acids. Other examples may include: aromatic hydroxycarboxylic acids, aromatic mono- and poly-carboxylic acids, and their metal salts, anhydrides and esters, and phenol derivatives, such as bisphenols. Among the above, monoazo metal complexes are preferred.

The toner according to the present invention may preferably have a volume-average particle size of 4–8 microns so as to faithfully reproduce small size digital latent images.

It is preferred to use the toner according to the present invention together with silica fine powder blended therewith in order to improve the charge stability, developing characteristic and fluidity.

The silica fine powder used in the present invention provides good results if it has a specific surface area of 30 $m^2/g$ or larger, preferably 50–400 $m^2/g$, as measured by nitrogen adsorption according to the BET method. The silica fine powder may be added in a proportion of 0.01–8 wt. parts, preferably 0.1–5 wt. parts, per 100 wt. parts of the toner.

For the purpose of being provided with hydrophobicity and/or controlled chargeability, the silica fine powder may well have been treated with a treating agent, such as silicone varnish, modified silicone varnish, silicone oil, modified silicone oil, silane coupling agent, silane coupling agent having functional group or other organic silicon compounds. It is also preferred to use two or more treating agents in combination.

Other additives may be added as desired, inclusive of: a lubricant, such as polytetrafluoroethylene, zinc stearate or polyvinylidene fluoride, of which polyvinylidene fluoride is preferred; an abrasive, such as cerium oxide, silicon carbide or strontium titanate, of which strontium titanate is preferred; a flowability-imparting agent, such as titanium oxide or aluminum oxide, of which a hydrophobic one is preferred; an anti-caking agent, and an electroconductivity-imparting agent, such as carbon black, zinc oxide, antimony oxide, or tin oxide. It is also possible to use a small amount of white or black fine particles having a polarity opposite to that of the toner as a development characteristic improver.

It is also preferred to add 0.5–5 wt. % of a waxy substance, such as low-molecular weight polyethylene, low-molecular weight polypropylene, low-molecular weight propylene-ethylene copolymer, microcrystalline wax, carnauba wax, sasol wax or paraffin wax, to the toner for the purpose of improving the releasability of the toner at the time of hot roller fixation.

The toner according to the present invention can be mixed with carrier powder to be used as a two-component developer. In this instance, the toner and the carrier powder may be mixed with each other so as to provide a toner concentration of 0.1–50 wt. %, preferably 0.5–10 wt. %, further preferably 3–5 wt. %.

The carrier used for this purpose may be a known one, examples of which may include: powder having magnetism, such as iron powder, ferrite powder, and nickel powder and carriers obtained by coating these powders with a resin, such as a fluorine-containing resin, a vinyl resin or a silicone resin.

The toner according to the present invention can be constituted as a magnetic toner containing a magnetic material in its particles. In this case, the magnetic material can also function as a colorant. Examples of the magnetic material may include: iron oxide, such as magnetite, hematite, and ferrite; metals, such as iron, cobalt and nickel, and alloys of these metals with other metals, such as aluminum, cobalt, copper, lead, magnesium, tin, zinc, antimony, beryllium, bismuth, cadmium, calcium, manganese, selenium, titanium, tungsten and vanadium; and mixtures of these materials.

The magnetic material may have an average particle size of 0.1–2 micron, preferably 0.1–0.5 micron.

The magnetic material may preferably show magnetic properties under application of 10 kilo-Oersted, inclusive of: a coercive force of 20–30 Oersted, a saturation magnetization of 50–200 emu/g, and a residual magnetization of 2–20 emu/g. The magnetic material may be contained in the toner in a proportion of 20–200 wt. parts, preferably 40–150 wt. parts, per 100 wt. parts of the resin component.

The toner according to the present invention can contain a colorant which may be an appropriate pigment or dye.

Examples of the pigment may include: carbon black, aniline black, acetylene black, Naphthol Yellow, Hansa Yellow, Rhodamine Lake, Alizarin Lake, red iron oxide, Phthalocyanine Blue, and Indanthrene Blue. These pigments are used in an amount sufficient to provide a required optical density of the fixed images, and may be added in a proportion of 0.1–20 wt. parts, preferably 2–10 wt. parts, per 100 wt. parts of the binder resin.

Examples of the dye may include: azo dyes, anthraquinone dyes, xanthene dyes, and methine dyes, which may be added in a proportion of 0.1–20 wt. parts, preferably 0.3–10 wt. parts, per 100 wt. parts of the binder resin.

The toner according to the present invention may be prepared through a process including: sufficiently blending the binder resin, the organic metal compound such as the metal salt or metal complex, a colorant, such as pigment, dye and/or a magnetic material, and an optional charge control agent and other additives, as desired, by means of a blender such as a Henschel mixer or a ball mill, melting and kneading the blend by means of hot kneading means, such as hot rollers, a kneader or an extruder to cause melting of the resinous materials and disperse or dissolve the magnetic material, pigment or dye therein, and cooling and solidifying the kneaded product, followed by pulverization and classification.

The thus obtained toner may be further blended with other external additives, as desired, sufficiently by means of a mixer such as a Henschel mixer to provide a developer for developing electrostatic images.

Hereinbelow, the present invention will be described in more detail based on Examples. First of all, Synthesis Examples of binder resins for use in toners are explained, in which the glass transition temperatures (Tg) of the resins were measured by using a differential scanning calorimeter (DSC) ("DSC-7", available from Perkin-Elmer Co.) in the following manner.

A sample resin in an amount of 5–20 mg, preferably about 10 mg, is accurately weighed and placed in an aluminum pan (an empty pan being used as a reference). The measurement is performed in a normal temperature—normal humidity environment at a temperature raising rate of 10° C./min within a temperature range of 30° C. to 200° C. A heat absorption main peak is generally found in the range of 40–100 ° C.

Based on the heat absorption curve, a first base line as drawn along an initial shape before the main peak and a second base line is drawn along a final slope after the main peak. A medium line is drawn substantially in parallel with and with equal distances from the first and second lines, whereby the medium line and the heat absorption curve form an intersection with each other. The temperature at the intersection is taken as the glass transition temperature (Tg ° C.).

The values of Tg thus measured, various acid values and main peak positions on GPC chromatograms for the binder resins obtained in Synthesis Examples are summarized in Table 1 appearing after Synthesis Examples.

SYNTHESIS EXAMPLE 1

200 wt. parts of toluene was placed in a reaction vessel and heated to a reflux temperature. Then, the following mixture was added dropwise in 4 hours under toluene refluxing.

| | |
|---|---|
| Styrene monomer | 77 wt. parts |
| n-Butyl acrylate | 13 wt. parts |
| Monobutyl maleate | 10 wt. parts |
| Di-tert-butyl peroxide | 6 wt. parts |

Further, under toluene refluxing (120–130° C.), the polymerization was completed and the toluene was removed. The resultant styrene copolymer showed a main peak at a molecular weight of 7000 and a glass transition temperature (Tg) of 60° C.

30 wt. parts of the above styrene copolymer was dissolved in the following monomer mixture.

| | |
|---|---|
| Styrene monomer | 42 wt. part(s) |
| n-Butyl acrylate | 12 wt. part(s) |
| n-Butyl methacrylate | 12 wt. part(s) |
| Monobutyl maleate | 4 wt. part(s) |
| Divinylbenzene | 0.4 wt. part(s) |
| Benzoyl peroxide | 1.6 wt. part(s) |

To the resultant mixture was added, 170 wt. parts of water containing 0.1 wt. part of partially saponified polyvinyl alcohol to form a suspension liquid. Into a reaction vessel containing 15 wt. parts of water and purged with nitrogen, the above prepared suspension liquid was charged and subjected to 6 hours of suspension polymerization at 70–95 ° C. After the completion, the product was filtered out, de-watered and dried to obtain a resin composition containing a styrene copolymer crosslinked with divinylbenzene. The thus obtained resin composition provided a molecular weight distribution showing a main peak at a molecular weight of 7500 and a shoulder at a molecular weight of $3.5\times10^4$, a Tg of 60° C. and a JIS acid value of 22.0 mgKOH/g.

SYNTHESIS EXAMPLE 2

| | |
|---|---|
| Styrene monomer | 85 wt. parts |
| n-Butyl acrylate | 10 wt. parts |
| Acrylic acid | 5 wt. parts |
| Di-tert-butyl peroxide | 8 wt. parts |

The above mixture was added dropwise in 4 hours to 200 wt. parts of cumene heated to a reflux temperature. Further, the solution polymerization was completed under cumene refluxing (146–156° C.), followed by removal of the cumene, to recover a styrene copolymer. The styrene copolymer showed a main peak at a molecular weight of 5000 on its GPC chromatogram and a Tg of 65° C.

30 wt. parts of the above-prepared styrene copolymer was dissolved in the following monomer mixture.

| | |
|---|---|
| Styrene monomer | 44 wt. part(s) |
| n-Butyl acrylate | 10 wt. part(s) |
| n-Butyl methacrylate | 15 wt. part(s) |
| Monobutyl maleate | 1 wt. part(s) |
| Divinylbenzene | 0.5 wt. part(s) |
| Benzoyl peroxide | 1 wt. part(s) |
| tert-Butyl peroxy-2-ethylexanoate | 0.7 wt. part(s) |

To the resultant mixture, 170 wt. parts of water containing 0.1 wt. part of partially saponified polyvinyl alcohol was added to form a suspension liquid. Into a reaction vessel containing 15 wt. parts of water and purged with nitrogen, the above suspension liquid was charged and subjected to 6 hours of suspension polymerization at 70–95° C. After the completion of the reaction, the product was filtered out, de-watered and dried to obtain a resin composition.

The THF-soluble content of the thus-obtained resin composition provided a molecular weight distribution showing a main peak at a molecular weight of about 5200 and a shoulder at a molecular weight of about $3.4\times10^4$. The resin composition showed a Tg of 58° C. and a JIS acid value of 14.0 mgKOH/g.

SYNTHESIS EXAMPLE 3

| | |
|---|---|
| Styrene monomer | 80 wt. parts |
| n-Butyl acrylate | 10 wt. parts |
| Monobutyl maleate | 10 wt. parts |
| Di-tert-butyl peroxide | 10 wt. parts |

The above mixture was added dropwise in 4 hours to 150 wt. parts of cumene heated to a reflux temperature. Further, the solution polymerization was completed under cumene refluxing (146–156° C.), followed by removal of the cumene, to recover a styrene copolymer. The styrene copolymer showed a main peak at a molecular weight of 5500 and a Tg of 65° C.

35 wt. parts of the above-prepared styrene copolymer was dissolved in the following monomer mixture.

| | |
|---|---|
| Styrene monomer | 40 wt. part(s) |
| n-Butyl acrylate | 15 wt. part(s) |
| n-Butyl methacrylate | 5 wt. part(s) |
| Monobutyl maleate | 5 wt. part(s) |
| Divinylbenzene | 0.3 wt. part(s) |
| Benzoyl peroxide | 1.0 wt. part(s) |

To the resultant mixture, 170 wt. parts of water containing 0.1 wt. part of partially saponified polyvinyl alcohol was added to form a suspension liquid. Into a reaction vessel containing 15 wt. parts of water and purged with nitrogen, the above suspension liquid was charged and subjected to 6 hours of suspension polymerization at 70–95 ° C. After the completion of the reaction, the product was filtered out, de-watered and dried to obtain a resin composition.

The THF-soluble content of the thus-obtained resin composition provided a molecular weight distribution showing a main peak at a molecular weight of about 5800 and a shoulder at a molecular weight of about $5.0\times10^4$. The resin composition showed a Tg of 59° C. and a JIS acid value of 40.0 mgKOH/g.

SYNTHESIS EXAMPLE 4

| | |
|---|---|
| Styrene monomer | 60 wt. part(s) |
| n-Butyl acrylate | 17 wt. part(s) |
| n-Butyl methacrylate | 17 wt. part(s) |
| Monobutyl maleate | 6 wt. part(s) |
| Divinylbenzene | 0.1 wt. part(s) |
| tert-Butyl peroxy-2-ethylhexanoate | 0.8 wt. part(s) |

To the above mixture liquid, 170 wt. parts of water containing 0.1 wt. part of partially saponified polyvinyl alcohol was added to form a suspension liquid. Into a reaction vessel containing 15 wt. parts of water and purged with nitrogen, the above suspension liquid was charged and subjected to 6 hours of suspension polymerization at 70–95 ° C. to obtain a crosslinked styrene copolymer. The styrene copolymer provided a molecular weight distribution showing a main peak at a molecular weight of $3.0\times10^4$, a Tg of 61° C. and a JIS acid value of 20.0.

200 wt. parts of toluene was charged in another reaction vessel and heated to a reflux temperature, and the following mixture was added dropwise in 4 hours under toluene refluxing.

| | |
|---|---|
| Styrene monomer | 77 wt. parts |
| n-Butyl acrylate | 13 wt. parts |
| Monobutyl maleate | 10 wt. parts |
| Di-tert-butyl peroxide | 6 wt. parts |

Further, the polymerization was completed under toluene to form an un-crosslinked styrene copolymer. Then, into the reaction mixture, the above-prepared crosslinked styrene copolymer was added so as to provide a weight ratio of the crosslinked copolymer/the uncrosslinked copolymer=7/3. After sufficient stirring, the toluene was distilled off at an elevated temperature (120° C.) under vacuum to obtain a resin composition containing the crosslinked and uncrosslinked styrene copolymers. The resin composition provided a molecular weight distribution showing peaks at molecular weights of 7000 and $8\times10^4$, a Tg of 60° C. and a JIS acid value of 25.0.

SYNTHESIS EXAMPLE 5

| | |
|---|---|
| Styrene monomer | 77 wt. parts |
| n-Butyl acrylate | 13 wt. parts |
| Monobutyl maleate | 10 wt. parts |
| Di-tert-butyl peroxide | 1.2 wt. parts |

The above mixture was added dropwise in 4 hours to 200 wt. parts of toluene heated to a reflux temperature. Further, the solution polymerization was completed under toluene refluxing (120–130 ° C.), followed by removal of the toluene, to recover a styrene copolymer. The styrene copolymer showed a main peak at a molecular weight of $1.2\times10^4$ and a Tg of 60° C.

30 wt. parts of the above-prepared styrene copolymer was dissolved in the following monomer mixture.

| | |
|---|---|
| Styrene monomer | 42 wt. part(s) |
| n-Butyl acrylate | 12 wt. part(s) |
| n-Butyl methacrylate | 12 wt. part(s) |
| Monobutyl maleate | 4 wt. part(s) |
| Divinylbenzene | 0.4 wt. part(s) |
| Benzoyl peroxide | 1.0 wt. part(s) |

To the resultant mixture, 170 wt. parts of water containing 0.1 wt. part of partially saponified polyvinyl alcohol was added to form a suspension liquid. Into a reaction vessel containing 15 wt. parts of water and purged with nitrogen, the above suspension liquid was charged and subjected to 6 hours of suspension polymerization at 70–95 ° C. After the completion of the reaction, the product was filtered out, de-watered and dried to obtain a resin composition.

The thus-obtained resin composition provided a molecular weight distribution showing a main peak at a molecular weight of about $1.5\times10^4$ and a shoulder at a molecular weight of about $5.0\times10^4$. The resin composition showed a Tg of 54° C. and a JIS acid value of 22.0 mgKOH/g.

COMPARATIVE SYNTHESIS EXAMPLE 1

| | |
|---|---|
| Styrene monomer | 80 wt. parts |
| n-Butyl acrylate | 10 wt. parts |
| Monobutyl maleate | 10 wt. parts |
| Di-tert-butyl peroxide | 8 wt. parts |

The above mixture was added dropwise in 4 hours to 150 wt. parts of cumene heated to a reflux temperature. Further, the solution polymerization was completed under cumene refluxing (146–156° C.), followed by removal of the cumene, to recover a styrene copolymer. The styrene copolymer showed a main peak at a molecular weight of 4000 and a Tg of 58° C.

70 wt. parts of the above-prepared styrene copolymer was dissolved in the following monomer mixture.

| | |
|---|---|
| Styrene monomer | 25 wt. part(s) |
| n-Butyl acrylate | 5 wt. part(s) |
| Divinylbenzene | 0.2 wt. part(s) |
| Benzoyl peroxide | 0.8 wt. part(s) |

The resultant mixture was subjected to suspension polymerization in the same manner as in Synthesis Example 1 to obtain a resin composition, which showed a JIS acid value of 25.0 mgKOH/g. The THF-soluble content of the resin composition provided a molecular weight distribution showing a main peak at a molecular weight of about 4200 on its GPC chromatogram, and a Tg of 59° C.

COMPARATIVE SYNTHESIS EXAMPLE 2

| | |
|---|---|
| Styrene monomer | 85 wt. parts |
| n-Butyl acrylate | 10 wt. parts |
| Acrylic acid | 5 wt. parts |
| Di-tert-butyl peroxide | 8 wt. parts |

The above mixture was added dropwise in 4 hours to 200 wt. parts of cumene heated to a reflux temperature. Further, the solution polymerization was completed under cumene refluxing (146–156° C.), followed by removal of the cumene, to recover a styrene copolymer. The styrene copolymer showed a main peak at a molecular weight of 5000 on its GPC chromatogram and a Tg of 65° C.

30 wt. parts of the above-prepared styrene copolymer was dissolved in the following monomer mixture.

| | |
|---|---|
| Styrene monomer | 48 wt. part(s) |
| n-Butyl acrylate | 21 wt. part(s) |
| Monobutyl maleate | 1 wt. part(s) |
| Divinylbenzene | 1.0 wt. part(s) |
| tert-Butyl peroxy-2-ethylhexanoate | 0.7 wt. part(s) |

To the resultant mixture, 170 wt. parts of water containing 0.1 wt. part of partially saponified polyvinyl alcohol was added to form a suspension liquid. Into a reaction vessel containing 15 wt. parts of water and purged with nitrogen, the above suspension liquid was charged and subjected to 6 hours of suspension polymerization at 70–95° C. After the completion of the reaction, the product was filtered out, de-watered and dried to obtain a resin composition.

The THF-soluble content of the thus-obtained resin composition provided a molecular weight distribution showing a sub-peak at a molecular weight of about 5200 and a main peak at a molecular weight of about $7.2\times10^4$. The resin composition showed a Tg of 64° C. and a JIS acid value of 13.0 mgKOH/g.

COMPARATIVE SYNTHESIS EXAMPLE 3

| | |
|---|---|
| Styrene monomer | 85 wt. parts |
| n-Butyl acrylate | 15 wt. parts |
| Di-tert-butyl peroxide | 8 wt. parts |

The above mixture was added dropwise in 4 hours to 200 wt. parts of cumene heated to a reflux temperature. Further, the solution polymerization was completed under cumene refluxing (146–156° C.), followed by removal of the cumene, to recover a styrene copolymer. The styrene copolymer showed a main peak at a molecular weight of 5000 on its GPC chromatogram and a Tg of 62° C.

30 wt. parts of the above-prepared styrene copolymer was dissolved in the following monomer mixture.

| | |
|---|---|
| Styrene monomer | 48 wt. part(s) |
| n-Butyl acrylate | 21 wt. part(s) |
| Monobutyl maleate | 1 wt. part(s) |

-continued

| | |
|---|---|
| tert-Butyl peroxy-2-ethylhexanoate | 2.0 wt. part(s) |

To the resultant mixture, 170 wt. parts of water containing 0.1 wt. part of partially saponified polyvinyl alcohol was added to form a suspension liquid. Into a reaction vessel containing 15 wt. parts of water and purged with nitrogen, the above suspension liquid was charged and subjected to 6 hours of suspension polymerization at 70–95 ° C. After the completion of the reaction, the product was filtered out, de-watered and dried to obtain a resin composition.

The THF-soluble content of the thus-obtained resin composition provided a molecular weight distribution showing peaks at molecular weights of about 6000, and about $3.5\times10^4$, respectively. The resin composition showed a Tg of 56° C. and a JIS acid value of 1.5 mgKOH/g.

The above-mentioned properties, the total acid values and the acid values attributable to the acid anhydride of the resin compositions obtained in the above Synthesis Examples and Comparative Examples are summarized in the following Table 1.

TABLE 1

| Resin composition | Properties of resin compositions: Acid value (mgKOH/g) JIS | Total | Anhydride | GPC main peak (molecular weight) | Tg (°C.) |
|---|---|---|---|---|---|
| Synthesis 1 | 22.0 | 23.7 | 3.4 | 7,500 | 60 |
| Ex. 2 | 14.0 | 14.0 | 0.0 | 5,200 | 58 |
| 3 | 40.0 | 41.9 | 3.8 | 5,800 | 59 |
| 4 | 25.0 | 24.9 | 0.2 | 4,500 | 60 |
| 5 | 22.0 | 22.0 | 0.0 | 15,000 | 54 |
| Comp. 1 | 25.0 | 29.2 | 8.4 | 4,200 | 59 |
| Synthesis 2 | 13.0 | 13.0 | 0.0 | 72,000 | 64 |
| Ex. 3 | 1.5 | 1.5 | 0.0 | 35,000 | 56 |

EXAMPLE 1

| | |
|---|---|
| Resin composition of Synthesis Example 1 | 100 wt. part(s) |
| Magnetic material (triiron tetroxide) | 70 wt. part(s) |
| Monoazo Cr Complex [I]-1 | 0.8 wt. part(s) |
| Low-molecular weight propylene ethylene copolymer | 3 wt. part(s) |

The above ingredients were sufficiently blended in a blender and melt-kneaded through a twin-screw kneading extruder set at 110° C. The kneaded product was cooled, coarsely crushed by a cutter mill, and finely pulverized by means of a pulverizer using Jet air stream. The resultant finely pulverized powder was classified by means of a multi-division classifier utilizing a Coanda effect (Elbow Jet Classifier available from Nittetsu Kogyo K.K.), whereby ultra fine powder and coarse powder were simultaneously and precisely removed to obtain a magnetic toner having a volume-average particle size of 6.0 microns.

The above particle size was measured by using a Coulter counter ("TA-II" available from Coulter Electronics, Co.) by using a 100 micron-aperture after dispersion in 1% NaCl aqueous solution in the presence of a surfactant.

The above-prepared magnetic toner was subjected to preparation of a GPC sample having a resin concentration of 5 mg/ml, and no binder resin component was found to remain on the filter at that time. The GPC sample was subjected to measurement of molecular weight distribution by GPC using a high-speed liquid chromatograph ("150C" available from Waters Co.) and a combination of columns ("Shodex GPC KF-801, 802, 803, 804, 805, 806, 807 and 800P" available from Showa Denko K.K.). The measured molecular weight distribution data are shown in Table 2 appearing hereinafter.

100 wt. parts of the above-prepared magnetic toner and 1.0 wt. part of colloidal silica were blended with each other and evaluated for image formation. The results are shown in Table 3 appearing hereinafter. The image formation was performed by using a printer prepared by re-modeling a commercially available small-size laser beam printer ("LBP-SII" available from Canon K.K.) so as to provide a printing speed of 16 sheets (A4-vertical)/min., remove the fixing pad and be capable of forming latent images comprising minute spots of down to 50 microns by improving the scanner part. The evaluation was performed with respect to the initial image quality and fixability, and anti-offset characteristic and staining of hot fixing rollers after 5000 sheets of printing.

The fixability evaluation was performed as follows. The test apparatus was placed in an environment of normal temperature and normal humidity (temperature: 23° C. humidity: 60% ) After the apparatus and the fixing device therein were fully adapted to the environment, a power was supplied. Immediately after the waiting time was up, a pattern of 200 micron-wide transverse lines (line width: 200 microns, spacing: 200 microns) was printed on a first sheet, which was used for evaluation of the fixability. The fixability was evaluated by rubbing the printed image with a lens cleaning paper ("Dusper" (trade name), made by OZU Paper Co. Ltd.) for 5 reciprocations under a weight of 100 g and then evaluating the degree of peeling of the toner image in terms of a decrease (%) in reflection density.

For the evaluation of the hot fixing roller staining, a character pattern with a dot ratio of 4% was printed continuously on 5000 sheets (A4-vertical) by using a fresh fixing roller cleaning pad and thereafter the staining on the surface of the hot fixing roller was observed with eyes.

After the above observation, a 100 micron-wide transverse line pattern was continuously printed on 300 sheets (A4-vertical), then the printing was paused for 30 seconds and then the printing was resumed so as to print an image comprising an upper half area including a pattern of 100 micron-wide transverse lines and a lower half area in white. Then, the front face staining on a first sheet after the resumption was observed for evaluation of the anti-offset characteristic.

For the above evaluation, bond paper having a surface smoothness of 10 [sec] or below was used as the transfer paper.

EXAMPLE 2

| | |
|---|---|
| Resin composition of Synthesis Example 2 | 100 wt. part(s) |
| Magnetic material (triiron tetroxide) | 120 wt. part(s) |
| Monoazo Cr complex [I]-2 | 0.7 wt. part(s) |
| Low-molecular weight propylene-ethylene copolymer | 4 wt. part(s) |

A magnetic toner having a volume-average particle size of 4.5 microns was prepared from the above ingredients otherwise in the same manner as in Example 1. The properties of the magnetic toner are shown in Table 2. The magnetic toner in an amount of 100 wt. parts was blended with 0.8 wt. part of colloidal silica fine powder to prepare a developer, which was then evaluated for image formation in the same manner as in Example 1. The results are shown in Table 3.

EXAMPLE 3

| | |
|---|---|
| Resin composition of Synthesis Example 3 | 100 wt. part(s) |
| Magnetic material (triiron tetroxide) | 90 wt. part(s) |
| Monoazo Co complex [I]-3 | 0.9 wt. part(s) |
| Low-molecular weight propylene-ethylene copolymer | 3 wt. part(s) |

A magnetic toner having a volume-average particle size of 7.7 microns was prepared from the above ingredients otherwise in the same manner as in Example 1. The properties of the magnetic toner are shown in Table 2. The magnetic toner in an amount of 100 wt. parts was blended with 1.1 wt. parts of colloidal silica fine powder to prepare a developer, which was then evaluated for image formation in the same manner as in Example 1. The results are shown in Table 3.

EXAMPLE 4

| | |
|---|---|
| Resin composition of Synthesis Example 4 | 100 wt. part(s) |
| Magnetic material (triiron tetroxide) | 90 wt. part(s) |
| Monoazo Co complex [I]-4 | 0.8 wt. part(s) |
| Low-molecular weight propylene-ethylene copolymer | 3 wt. part(s) |

A magnetic toner having a volume-average particle size of 6.8 microns was prepared from the above ingredients otherwise in the same manner as in Example 1. The properties of the magnetic toner are shown in Table 2. The magnetic toner in an amount of wt. parts was blended with 1.1 wt. parts of colloidal silica fine powder to prepare a developer, which was then evaluated for image formation in the same manner as in Example 1. The results are shown in Table 3.

EXAMPLE 5

| | |
|---|---|
| Resin composition of Synthesis Example 5 | 100 wt. part(s) |
| Magnetic material (triiron tetroxide) | 90 wt. part(s) |
| 3,5-Di-tert-butylsalicylic acid Cr complex | 2 wt. part(s) |
| Low-molecular weight propylene-ethylene copolymer | 4 wt. part(s) |

A magnetic toner having a volume-average particle size of 4.5 microns was prepared from the above ingredients otherwise in the same manner as in Example 1. The properties of the magnetic toner are shown in Table 2. The magnetic toner in an amount of wt. parts was blended with 0.8 wt. part of colloidal silica fine powder to prepare a developer, which was then evaluated for image formation in the same manner as in Example 1. The results are shown in Table 3.

COMPARATIVE EXAMPLE 1

| | |
|---|---|
| Resin composition of Comparative Synthesis Example 2 | 100 wt. part(s) |
| Magnetic material (triiron tetroxide) | 100 wt. part(s) |
| Monoazo Cr complex [I]-2 | 2 wt. part(s) |

-continued

| | |
|---|---|
| Low-molecular weight propylene-ethylene copolymer | 3 wt. part(s) |

A magnetic toner having a volume-average particle size of 6.0 microns was prepared from the above ingredients otherwise in the same manner as in Example 1. The properties of the magnetic toner are shown in Table 2. The magnetic toner in an amount of 100 wt. parts was blended with 1.0 wt. part of colloidal silica fine powder to prepare a developer, which was then evaluated for image formation in the same manner as in Example 1. The results are shown in Table 3.

COMPARATIVE EXAMPLE 2

| | |
|---|---|
| Resin composition of Comparative Synthesis Example 2 | 100 wt. part(s) |
| Magnetic material (triiron tetroxide) | 60 wt. part(s) |
| 3,5-Di-tert-butylsalicylic acid Cr complex | 0.7 wt. part(s) |
| Low-molecular weight propylene-ethylene copolymer | 3 wt. part(s) |

A magnetic toner having a volume-average particle size of 11 microns was prepared from the above ingredients otherwise in the same manner as in Example 1. The properties of the magnetic toner are shown in Table 2. The magnetic toner in an amount of 100 wt. parts was blended with 0.5 wt. part of colloidal silica fine powder to prepare a developer, which was then evaluated for image formation in the same manner as in Example 1. The results are shown in Table 3.

COMPARATIVE EXAMPLE 3

| | |
|---|---|
| Resin composition of Comparative Synthesis Example 3 | 100 wt. part(s) |
| Magnetic material (triiron tetroxide) | 80 wt. part(s) |
| Monoazo Co complex [I]-3 | 0.8 wt. part(s) |
| Low-molecular weight propylene-ethylene copolymer | 3 wt. part(s) |

A magnetic toner having a volume-average particle size of 9.5 microns was prepared from the above ingredients otherwise in the same manner as in Example 1. The properties of the magnetic toner are shown in Table 2. The magnetic toner in an amount of 100 wt. parts was blended with 1.1 wt. parts of colloidal silica fine powder to prepare a developer, which was then evaluated for image formation in the same manner as in Example 1. The results are shown in Table 3.

TABLE 2

| | Properties of binder resin in toner | | | | | |
|---|---|---|---|---|---|---|
| | Molecular weight distribution | | | | | |
| | Weight fraction (wt. %) | | | | Main peak | |
| | ≦5,000 | 5,000–100,000 | 100,000–5,000,000 | ≧5,000,000 | (molecular weight) | JIS acid value (KOH mg/g) |
| Example 1 | 19.4 | 47.4 | 26.2 | 7.0 | 7,600 | ca. 22 |
| 2 | 29.6 | 48.0 | 19.4 | 3.0 | 5,400 | ca. 14 |
| 3 | 23.0 | 49.5 | 20.6 | 6.9 | 6,300 | ca. 40 |
| 4 | 29.1 | 49.8 | 17.4 | 3.7 | 5,300 | ca. 25 |
| 5 | 15.2 | 48.0 | 9.6 | 27.2 | 16,000 | ca. 22 |
| Comp. 1 | 40.3 | 40.2 | 15.2 | 4.3 | 4,300 | ca. 25 |
| Example 2 | 11.9 | 42.5 | 25.8 | 19.8 | 120,000 | ca. 13 |
| 3 | 31.3 | 51.0 | 16.9 | 0.8 | 36,000 | ca. 1 |

TABLE 3

| | Fixability | Anti-offset | Pulverizability* | Hot fixing roller stain (after 5000 sheets) |
|---|---|---|---|---|
| Example 1 | ○ | ○ | ○ | ○ |
| 2 | ○ | ○ | ○ | ○ |
| 3 | ○ | ○ | ○ | ○ |
| 4 | ○ | ○ | ○ | ○ |
| 5 | Δ | ○ | ○ | ○ |
| Comp. 1 | ○ | x | ○ | x |
| Example 2 | x | ○ | x | ○ |
| 3 | ○ | x | ○ | Δ |

*Pulverizability of kneaded product for toner production. The evaluation standards for the respective items are given on the next page.

The evaluation standards are shown below.

(1) Fixability
- ○: Good (density lowering of below 10%)
- Δ: Somewhat inferior but practically acceptable (density lowering of 10% to below 20%)
- x: Practically not acceptable (density lowering of 20% or more)

(2) Hot fixing roller staining in the fixing device
- ○: No stain at all
- ○Δ: Slight stain which is almost unnoticeable
- Δ: Noticeable stain but practically acceptable (no offsetting)
- x: Conspicuous stain and practically not acceptable (offsetting)

(3) Anti-offset characteristic (front face stain after pause)
- ○: No stain at all
- ○Δ: Almost unnoticeable
- Δ: Stain but practically acceptable
- x: Conspicuous stain and practically unacceptable (4) Pulverizability
- ○: No over-pulverization and good pulverization efficiency
- x: Poor pulverization efficiency resulting in much coarse particles.

As has been described hereinabove, according to the present invention, there is provided a toner capable of forming high-quality images with improved performances in respects of anti-offset characteristic and fixing-roller staining. Particularly, the toner according to the present invention shows the following advantageous properties.

(1) Fixable at low temperature with improved anti-offset characteristic and causing little stain on fixed images.

(2) No or little melt-sticking or filming on a toner-carrying member or a photosensitive member.

(3) Excellent in anti-blocking characteristic and storability.

(4) Capable of faithfully reproducing latent images to form high-quality images.

(5) Having a high productivity because of good pulverizability of the binder resin.

What is claimed is:

1. A toner for developing an electrostatic image, comprising: a binder resin and a colorant, wherein the binder resin shows a molecular weight distribution on a GPC chromatogram of its tetrahydrofuran (THF)-soluble resin content including at least 15% and below 35% of a resin component in a molecular weight region of at most 5000 and at least 3% of a resin component in a molecular weight region of at least $5\times10^6$ and showing a main peak in a molecular weight region of 5000 to $10^5$, and the binder resin has an acid value of 2–100 mg KOH/g.

2. The toner according to claim 1, wherein said binder resin comprises a vinyl polymer, a vinyl copolymer or a mixture thereof.

3. The toner according to claim 1, wherein said binder resin comprises a vinyl copolymer composition.

4. The toner according to claim 1, wherein said binder resin comprises a mixture of a crosslinked vinyl copolymer and a non-crosslinked vinyl copolymer.

5. The toner according to claim 1, wherein said binder resin comprises a mixture of a crosslinked styrene copolymer and a non-crosslinked styrene copolymer.

6. The toner according to claim 1, wherein said binder resin contains a crosslinkage formed by a crosslinking agent having at least two vinyl groups, and an electrostatic crosslinkage formed by a carboxylic group and a metal ion of two or more valences.

7. The toner according to claim 1, wherein said binder resin shows a molecular weight distribution including 3–20% of a resin component in the molecular weight region of at least $5\times10^6$.

8. The toner according to claim 1, wherein said binder resin shows a molecular weight distribution including 3–10% of a resin component in the molecular weight region of at least $5\times10^6$.

9. The toner according to claim 1, wherein said binder resin shows a molecular weight distribution including at most 35% of a resin component in the molecular weight of $10^5$ to $5\times10^6$.

10. The toner according to claim 1, wherein said binder resin shows a molecular weight distribution including 18–32% of a resin component in the molecular weight region of at most 5000, 10–30% of a resin component in the molecular weight region of $10^5$ to $5\times10^6$, and 3–20% of a resin component in the molecular weight region of at least $5\times10^6$.

11. The toner according to claim 1, wherein said binder resin has a carboxyl group and contains an organic metal compound electrostatically linkable with the carboxylic group.

12. The toner according to claim 1, wherein said binder resin shows a molecular weight distribution showing a main peak in a molecular weight region of $10^4$ to $5\times10^4$.

13. The toner according to claim 1, wherein said binder resin shows a molecular weight distribution including at least 40% of a resin component in a molecular weight region of 5000 to $10^5$.

14. The toner according to claim 1, wherein said binder resin shows a molecular weight distribution including 18–32% of a resin component in the molecular weight region of at most 5000, at least 40% of a resin component in a molecular weight region of 5000 to $10^5$, and 3–20% of a resin component in the molecular weight region of at least $5\times10^6$.

15. The toner according to claim 1, wherein said binder resin has a JIS acid value of 5–70 mgKOH/g.

16. The toner according to claim 1, wherein said binder resin has an acid value attributable to acid anhydride group of at most 10 mgKOH/g.

17. The toner according to claim 1, wherein said binder resin has an acid value attributable to acid anhydride group of below 6 mgKOH/g.

18. The toner according to claim 1, wherein said binder resin contains a styrene-maleic acid half ester copolymer.

19. The toner according to claim 1, wherein said binder resin contains a styrene-maleic acid ester copolymer.

20. The toner according to claim 1, wherein said binder resin contains a styrene-maleic anhydride copolymer.

21. The toner according to claim 1, wherein said binder resin contains a non-crosslinked styrene-maleic acid half ester copolymer and a styrene-maleic acid half ester copolymer crosslinked with divinylbenzene.

22. The toner according to claim 1, wherein said colorant comprises a magnetic material.

23. The toner according to claim 1, wherein said colorant comprises carbon black.

24. The toner according to claim 1, wherein said binder resin has a carboxyl group or acid anhydride group and contains an organic metal compound reactive with the carboxyl group or acid anhydride group.

25. The toner according to claim 24, wherein said organic metal compound comprises an azo metal complex represented by the following formula:

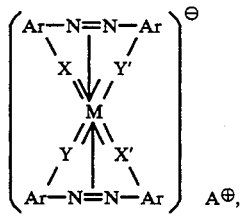

wherein M denotes a coordination center metal having a coordination number of 6 Ar denotes an aryl group capable of having a substituent X, X' Y and Y' independently denote —O—, —CO—, —NH—, or —NR— wherein R denotes an alkyl having 1–4 carbon atoms; and A⊕ denotes hydrogen, sodium, potassium, ammonium or aliphatic ammonium.

26. The toner according to claim 24, wherein said organic metal compound comprises an organic acid metal complex represented by the following formula:

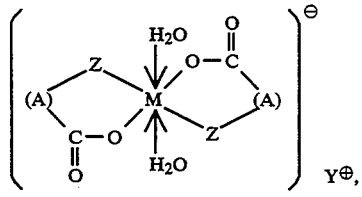

wherein M denotes a coordination center metal, having a coordination number of 6 A denotes

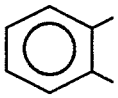

capable of having a substituent,

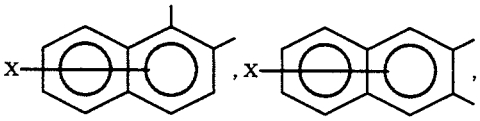

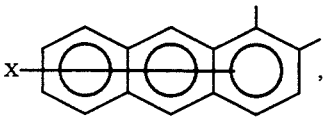

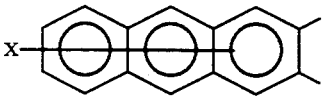

X denotes hydrogen, halogen, or nitro,

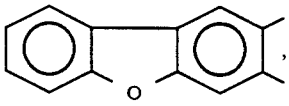

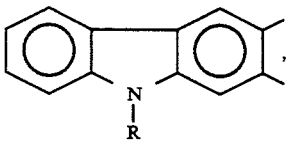

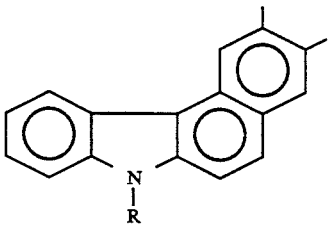

R denotes hydrogen, $C_1$–$C_{18}$ alkyl or $C_1$–$C_{18}$ alkenyl); $Y^{\oplus}$ denotes a counter ion: and Z denotes —O— or —C·O—.

27. The toner according to claim 1, wherein a waxy substance is further contained.

28. The toner according to claim 1, wherein said binder resin shows a molecular weight distribution on the GPC chromatogram showing a maximum in the molecular weight region of at least $5\times10^6$.

29. The toner according to claim 1, wherein the binder resin contains a THF-insoluble resin component in a proportion of at most 10 wt. % measured as a residue on a filter having a pore size of 0.45–0.5 micron when the binder resin is mixed with THF to provide a concentration of 5 mg/ml and the mixture is left standing for about 30 hours at room temperature and then subjected to filtration by using the filter.

30. The toner according to claim 29, wherein the THF-insoluble resin component is contained in a proportion of at most 10 wt. % in the binder resin.

31. The toner according to claim 29, wherein the THF-insoluble resin component is substantially zero in the binder resin.

32. A process for producing a toner, comprising:

mixing a resin composition, a colorant and an organic metal compound to obtain a mixture, the resin composition containing a crosslinkage formed with a crosslinking agent having at least two vinyl groups and a carboxyl group;

heating said mixture;

melt-kneading the heated mixture while exerting a shearing force to the mixture, so as to sever molecular chains of a high molecular weight component in the resin composition under the action of the shearing force and form an electrostatic linkage between the carboxylic group and the organic metal compound or a metal ion in the organic metal compound under heating;

cooling the resultant kneaded product;

pulverizing the cooled kneaded product; and classifying the resultant pulverized product to obtain a toner;

said toner comprising binder resin and a colorant; wherein the binder resin shows a molecular weight distribution on a GPC chromatogram of its tetrahydrofuran (THF)-soluble resin content including at least 15% and below 35% of a resin component in a molecular weight region of at most 5000 and at least. 3% of a resin component in a molecular weight region of at least $5\times10^6$ and showing a main peak in a molecular weight region of 5000 to $10^5$, and the binder resin has an acid value of 2–100 mg KOH/g.

33. The process according to claim 32, wherein a THF-insoluble component in the resin composition is converted into a THF-soluble component under the action of the shearing force during the melt-kneading.

34. The process according to claim 32, wherein the heated mixture is kneaded under the action to the shearing force so as to provide a peak in the molecular weight region of at least $5\times10^6$ on a GPC chromatogram of the binder resin.

35. The process according to claim 32, wherein the binder resin contains a THF-insoluble resin component in a proportion of at most 10 wt. % measured as a residue on a filter having a pore size of 0.45–0.5 micron when the binder resin is mixed with THF to provide a concentration of 5 mg/ml and the mixture is left standing for about 30 hours at room temperature and then subjected to filtration by using the filter.

36. The process according to claim 35, wherein the THF-insoluble resin component is contained in a proportion of at most 10 wt. % in the binder resin.

37. The process according to claim 35, wherein the THF-insoluble resin component is substantially zero in the binder resin.

38. The toner according to claim 1, wherein said binder resin contains a copolymer prepared from two or more species of acrylic monomers.

39. The toner according to claim 38, wherein said acrylic monomer comprise an acrylate ester and a methacrylate ester.

40. The toner according to claim 1, wherein said resin component in a molecular weight region of at least $5\times10^6$ contains a copolymer prepared from two or more species of acrylic monomer comprising an acrylate ester and a methacrylate ester.

41. The toner according to claim 1, wherein said binder resin contains a polymer or copolymer prepared from a monomer in the form of an $\alpha,\beta$-unsaturated dibasic acid, a half ester of an $\alpha,\beta$-unsaturated dibasic acid, a half ester of an $\alpha,\beta$-unsaturated dibasic acid or an ester of an $\alpha,\beta$-unsaturated dibasic acid.

42. The toner according to claim 1, wherein said binder resin contains a polymer or copolymer prepared from a monomer in the form of a monoester of an $\alpha,\beta$-unsaturated dibasic acid.

43. The process according to claim 32, wherein said binder resin contains a copolymer prepared from two or more species of acrylic monomers.

44. The process according to claim 43, wherein said acrylic monomers comprise an acrylate ester and a methacrylate ester.

45. The process according to claim 32, wherein said resin component in a molecular weight region of at least $5\times10^6$ contains a copolymer prepared from two or more species of acrylic monomer comprising an acrylate ester and methacrylate ester.

46. The process according to claim 32, wherein said resin composition contains a polymer or copolymer prepared from a monomer in the form of an $\alpha,\beta$-unsaturated dibasic acid, a half ester of an $\alpha,\beta$-unsaturated dibasic acid or an ester of an $\alpha,\beta$-unsaturated dibasic acid, so that said binder resin of the resultant toner contains a polymer or copolymer prepared from the monomer in the form of an $\alpha,\beta$-unsaturated dibasic acid, a half ester of an $\alpha,\beta$-unsaturated dibasic acid or an ester of an $\alpha,\beta$-unsaturated dibasic acid.

47. The process according to claim 32, wherein said resin composition contains a polymer or copolymer prepared from a monomer in the form of monoester of $\alpha,\beta$-unsaturated dibasic acid, so that said binder resin of the toner contains a polymer or copolymer prepared from the monoester of an $\alpha,\beta$-unsaturated dibasic acid.

48. The toner according to claim 25, wherein M is Sc, Ti, V, Cr, Co, Ni or Fe; Ar is phenyl or naphthyl; optionally substituted with nitro, halogen, carboxyl, anilide, alkyl having 1–18 carbon atoms or alkoxy having 1–18 carbon atoms.

49. The toner according to claim 26, wherein M is Cr, Co, Ni or Fe and Y is hydrogen, sodium, potassium, ammonium or aliphatic ammonium.

* * * * *

UNITED STATES PATENT AND TRADEMARK OFFICE

CERTIFICATE OF CORRECTION

PATENT NO. : 5,338,638

DATED : August 16, 1994

INVENTOR(S) : KIYOKO TSUCHIYA, ET AL.

It is certified that error appears in the above-identified patent and that said Letters Patent is hereby corrected as shown below:

COLUMN 2

Line 17, "improved in" should read --an improved--.

COLUMN 3

Line 27, "in a large amount is" should read --are--.
Line 59, "an" should read --and an--.

COLUMN 4

Line 6, "so" should read --so as--.
Line 30, "space." should read --spaces.-- and "spaces" should read --space--.
Line 48, "$15\times10^5$-$2\times10^6$" should read --$1.5\times10^5$-$2\times10^6$-- and "1-10% How" should read --1-10%. How--.

COLUMN 5

Line 33, "$10^5$ and" should read --$10^5$, and--.

COLUMN 6

Line 41, "further" should be deleted.
Line 42, "preferably" should read --preferably,--.

COLUMN 7

Line 12, "a" should be deleted.

COLUMN 8

Line 6, "5-$10^6$" should read --$5\times10^6$--.
Line 34, "for-improving" should read --for improving--.

--

UNITED STATES PATENT AND TRADEMARK OFFICE

CERTIFICATE OF CORRECTION

PATENT NO. : 5,338,638

DATED : August 16, 1994

INVENTOR(S) : KIYOKO TSUCHIYA, ET AL.

It is certified that error appears in the above-identified patent and that said Letters Patent is hereby corrected as shown below:

COLUMN 9

Line 11, "$5\times10^4$" should read --$5\times10^4$,--.

COLUMN 10

Line 42, "to the for a toner accordingly, it" should read --to the toner, accordingly it--.
Line 52, "measure" should read --measured--.

COLUMN 12

Line 2, "a" should be deleted.

COLUMN 14

Line 17, "A example" should read --may, for example,--.
Line 21, "monomer-to" should read --monomer to--.
Line 50, "vinylnaphthalenes;" should read --vinyl-naphthalenes;--.
Line 52, "methacryronitrile," should read --methacrylonitrile,--.

COLUMN 15

Line 16, "anhydes" should read --anhydrides--.

COLUMN 16

Line 49, "X'Y" should read --X', Y--.
Line 51, "atoms;" should read --atoms);--.
Line 54, "complexes" should read --complex--.

--

UNITED STATES PATENT AND TRADEMARK OFFICE

CERTIFICATE OF CORRECTION

PATENT NO. : 5,338,638

DATED : August 16, 1994

INVENTOR(S) : KIYOKO TSUCHIYA, ET AL.

It is certified that error appears in the above-identified patent and that said Letters Patent is hereby corrected as shown below:

COLUMN 21

Line 22, "as" should read --is--.

COLUMN 26

Line 53, "Jet" should read --jet--.

COLUMN 27

Line 15, "("LBP-SII")" should read --("LBP-8II")--.

COLUMN 28

Line 57, "wt. parts" should read --100 wt. parts--.

COLUMN 32

Line 48, "6 Ar" should read --6; Ar--.
Line 49, "substituent X, X'Y" should read --substituent; X, X', Y--.
Line 68, "6 A" should read --6; A--.

COLUMN 33

Line 26, "X" should read --wherein X-- and "halogen," should read --halogen, alkyl--.
Line 50, "R" should read --wherein R-- and "alkenyl);" should read --alkenyl;--.
Line 53, "—C·O—." should read -- —CO·O—.--.

--

UNITED STATES PATENT AND TRADEMARK OFFICE

CERTIFICATE OF CORRECTION

PATENT NO. : 5,338,638

DATED : August 16, 1994

INVENTOR(S) : KIYOKO TSUCHIYA, ET AL.

It is certified that error appears in the above-identified patent and that said Letters Patent is hereby corrected as shown below:

COLUMN 34

Line 32, "least." should read --least--.

COLUMN 35

Line 7, "acid, a half ester of an α, β-unsaturated dibasic" should be deleted.

COLUMN 36

Line 17, "Ni or" should read --Ni, Mn or--.
Line 22, "Ni or" should read --Ni, Mn or--.

Signed and Sealed this

Fourteenth Day of February, 1995

Bruce Lehman

*Attest:*

BRUCE LEHMAN

*Attesting Officer*

*Commissioner of Patents and Trademarks*

--